US011501729B2

(12) United States Patent
Taniguchi et al.

(10) Patent No.: US 11,501,729 B2
(45) Date of Patent: Nov. 15, 2022

(54) SOURCE DRIVER THAT ADJUSTS A TIMING OF OUTPUTTING OF PIXEL DATA BASED ON A LENGTH OF A SOURCE LINE, AND DISPLAY DEVICE

(71) Applicant: LAPIS Semiconductor Co., Ltd., Yokohama (JP)

(72) Inventors: Naoki Taniguchi, Yokohama (JP); Hiroshi Tsuchi, Yokohama (JP); Takashi Ohno, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 17/114,989

(22) Filed: Dec. 8, 2020

(65) Prior Publication Data

US 2021/0183328 A1 Jun. 17, 2021

(30) Foreign Application Priority Data

Dec. 13, 2019 (JP) ..... JP2019-225189
Mar. 23, 2020 (JP) ..... JP2020-051237

(51) Int. Cl.

| | |
|---|---|
| ***G09G 3/36*** | (2006.01) |
| ***G09G 3/3275*** | (2016.01) |
| ***G09G 3/3266*** | (2016.01) |
| ***G09G 3/3233*** | (2016.01) |

(52) U.S. Cl.

CPC ..... *G09G 3/3688* (2013.01); *G09G 3/3266* (2013.01); *G09G 3/3275* (2013.01); *G09G 3/3677* (2013.01); *G09G 3/3696* (2013.01); *G09G 3/3233* (2013.01); *G09G 2310/08* (2013.01); *G09G 2320/0233* (2013.01); *G09G 2330/028* (2013.01)

(58) Field of Classification Search

None

See application file for complete search history.

(56) References Cited

U.S. PATENT DOCUMENTS

| | | | | |
|---|---|---|---|---|
| 2007/0152947 | A1* | 7/2007 | Tanaka | G09G 3/3688 345/100 |
| 2007/0171171 | A1* | 7/2007 | Hector | G09G 3/20 345/98 |
| 2009/0184913 | A1* | 7/2009 | Sato | G09G 3/3648 345/99 |
| 2015/0221276 | A1* | 8/2015 | Ishii | G09G 3/3685 345/98 |
| 2017/0011703 | A1* | 1/2017 | Higuchi | G09G 3/3674 |
| 2021/0201838 | A1* | 7/2021 | Wei | G09G 3/3688 |

FOREIGN PATENT DOCUMENTS

| | | | |
|---|---|---|---|
| JP | 2004094014 | A | 3/2004 |
| JP | 5380765 | B2 | 1/2014 |

* cited by examiner

*Primary Examiner* — Kirk W Hermann

(74) *Attorney, Agent, or Firm* — Rabin & Berdo, P.C.

(57) ABSTRACT

A source driver includes a data latch unit that outputs acquired pixel data, a gradation voltage conversion unit that acquires the pixel data outputted from the data latch unit and converts the pixel data to gradation voltages, an output unit that amplifies and outputs the gradation voltages to source lines, and a timing control unit that controls the timing of the output of the pixel data from the data latch unit. The timing control unit performs control such that the longer a source line is from a source driver to a pixel column, the smaller the timing difference is between acquisition of the pixel data by the data latch unit and the output of the pixel data.

13 Claims, 12 Drawing Sheets

SOURCE DRIVER THAT ADJUSTS A TIMING OF OUTPUTTING OF PIXEL DATA BASED ON A LENGTH OF A SOURCE LINE, AND DISPLAY DEVICE

CROSS REFERENCE TO RELATED APPLICATIONS

This application is based upon and claims the benefit of priority of the prior Japanese Patent Application No. 2019-225189, filed on Dec. 13, 2019 and the prior Japanese Patent Application No. 2020-051237, filed on Mar. 23, 2020, the entire contents of which are incorporated herein by reference.

TECHNICAL FIELD

The present invention relates to a source driver and a display device.

BACKGROUND ART

The active matrix driving method is used as a driving method for a display device including a display unit of a liquid crystal or organic EL (electroluminescence) type or the like. In a display device of an active matrix driven type, the display panel is constituted of a semiconductor substrate in which pixel units and pixel switches are arranged in a matrix. Display is performed by using a gate signal to control the pixel switches so as to be ON or OFF, such that when each of the pixel switches is ON, a gradation voltage signal corresponding to an image data signal is supplied to the pixel unit, thereby controlling the luminance of each pixel unit. The supply of the gate signal to the pixel switches is performed by the gate driver via scanning lines (that is, gate lines). Also, the supply of the gradation voltage signals to the pixel units is performed by the source driver via source lines. The gate driver supplies a gate signal that is at least binary, whereas the source driver supplies a multi-level gradation voltage signal according to the gradation voltage.

In a display device in which the gate driver and the source driver are disposed on one side of the display panel, there are cases in which the quality of the display image is degraded as a result of unbalanced wiring load caused by wiring resistance and capacitance of wiring lines between the gate driver (that is, the scanning driver) and the scanning lines. A display device in which the display panel is split into a plurality or regions according to the wiring load of the wiring lines between the scanning driver and the scanning lines, and gate signals of differing pulse widths depending on the region are applied to the scanning lines is proposed (see, for example, Japanese Patent No. 5380765).

SUMMARY OF THE INVENTION

In recent years, there has been increased demand for display devices having high resolution and large screen display panels such as 4K panels (pixel columns: 3840× RGB, pixel rows: 2160) or 8K panels (double the pixel columns and pixel rows of a 4K panel) for use as display devices in TVs and monitors. A display device having such a large screen display panel requires high resolution and high-speed driving of the panel. As a result, the wiring resistance (load capacitance) of the source lines and scanning lines increases, resulting in increased parasitic resistance and capacitance in the display panel.

If the load capacitance of the source line increases, for example, the signal waveform of the gradation voltage signal supplied from the source driver has almost no reduction in sharpness in the signal rise and fall at positions on the source line where the distance from the source driver is relatively short, whereas, there is more reduction in sharpness in the signal rise and fall as the distance from the source driver increases. As a result, output delays occur, causing the charging rate for the pixel electrodes to decrease at positions on the source line that are relatively far from the source driver. This has resulted in the problem that it is not possible to set a uniform writing voltage in the display panel, causing image quality degradation resulting from uneven luminance or the like. Also, reduction in the wiring resistance (that is, expansion of the wiring width) of the scanning lines and the source lines in order to decrease the luminance unevenness results in the problem of decreased transmittance of the panel.

The present invention takes into consideration the above-mentioned problems, and an object thereof is to provide a display device by which it is possible to mitigate the occurrence of uneven luminance resulting from a decrease in writing voltage in the pixel electrodes.

A source driver according to the present invention is a source driver connected to a display panel having m source lines and n gate lines (m and n being integers of 2 or greater), and m×n pixel units provided in a matrix at respective intersections between the m source lines and the n gate lines, the source driver being configured to receive one frame of an image data signal formed by a sequence of n pixel data piece groups that each include m pixel data pieces and to generate gradation voltage signals to be supplied to the m×n pixel units on the basis of the image data signal, the source driver including: a data latch unit configured to sequentially acquire the n pixel data piece groups from the image data signal at a prescribed period and sequentially output, from m output terminals corresponding to the m source lines, the m pixel data pieces included in the acquired pixel data piece group; a gradation voltage conversion unit configured to sequentially acquire the m pixel data pieces outputted from the data latch unit and convert the pixel data pieces to m gradation voltages; an output unit configured to amplify and output the m gradation voltages to the m source lines; and a timing control unit configured to control a timing for outputting the m pixel data pieces from the data latch unit, wherein each of the n pixel data piece groups corresponds to the gradation voltage signals supplied respectively to n pixel columns constituted of the pixel units disposed along each of the n gate lines, and wherein the timing control unit controls the timing for the output of the data latch unit such that as a length of the source lines from the source driver to the pixel columns increases, a timing difference decreases between a timing at which the pixel data piece groups corresponding to the gradation voltage signals supplied to the pixel columns are acquired by the data latch unit, and a timing at which the m pixel data pieces constituting the pixel data piece groups are outputted by the data latch unit.

Also, a display device according to the present invention includes: a display panel having m source lines and n gate lines (m and n being integers of 2 or greater), and m×n pixel units provided in a matrix at respective intersections between the m source lines and the n gate lines; a gate driver configured to supply, to the n gate lines, gate signals that control the pixel switches to be ON during a selection period based on a pulse width; a source driver configured to receive one frame of an image data signal formed by a sequence of n pixel data piece groups that each include m pixel data pieces and to generate gradation voltage signals to be supplied to the m×n pixel units on the basis of the image data signal; and a display controller configured to supply the image data signal to the source driver, wherein the source driver includes: a data latch unit configured to sequentially acquire the n pixel data piece groups from the image data signal at a prescribed period and sequentially output, from m output terminals corresponding to the m source lines, the m pixel data pieces included in the acquired pixel data piece group; a gradation voltage conversion unit configured to sequentially acquire the m pixel data pieces outputted from the data latch unit and convert the pixel data pieces to m gradation voltages; an output unit configured to amplify and output the m gradation voltages to the m source lines; and a timing control unit configured to control a timing for outputting the m pixel data pieces from the data latch unit, wherein each of the n pixel data piece groups corresponds to the gradation voltage signals supplied respectively to n pixel columns constituted of the pixel units disposed along each of the n gate lines, and wherein the timing control unit controls the timing for the output of the data latch unit such that as a length of the source lines from the source driver to the pixel columns increases, a timing difference decreases between a timing at which the pixel data piece groups corresponding to the gradation voltage signals supplied to the pixel columns are acquired by the data latch unit, and a timing at which the m pixel data pieces constituting the pixel data piece groups are outputted by the data latch unit.

According to the source driver of the present invention, it is possible to mitigate the occurrence of uneven luminance resulting from a decrease in writing voltage.

DETAILED DESCRIPTION OF EMBODIMENTS

Figure 1:
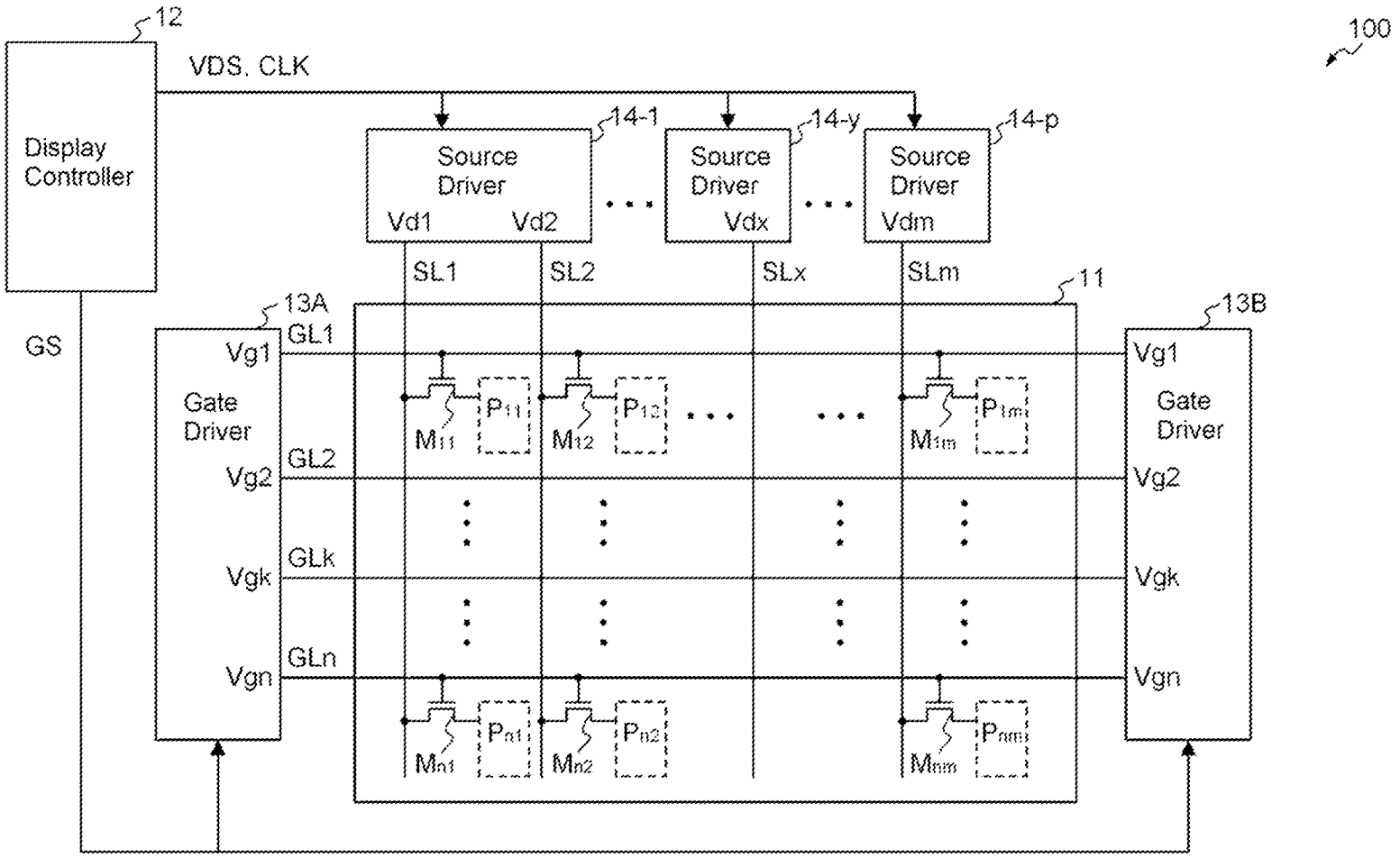
FIG. 1 is a block diagram showing a configuration of a display device of the present invention.

Suitable embodiments of the present invention will be explained below in detail. In the description of embodiments and the affixed drawings below, parts that are substantially the same or equivalent to each other are assigned the same reference characters.

Embodiment 1

FIG. 1 is a block diagram showing a configuration of a display device 100 of the present invention. The display device 100 is an active matrix driven liquid crystal display device. The display device 100 includes a display panel 11, a display controller 12, gate drivers 13A and 13B, and source drivers 14-1 to **14-*p***.

The display panel 11 is constituted of a semiconductor substrate on which a plurality of pixel units P11 to Pnm and pixel switches M11 to Mnm (n and m being natural numbers of 2 or greater) are arranged in a matrix. The display panel 11 has n gate lines GL1 to GLn and m source lines SL1 to SLm that are arranged so as to intersect with the gate lines. In the description below, a given gate line among the n gate lines GL1 to GLn is sometimes referred to as a gate line GLk and a given source line among the m source lines SL1 to SLm is sometimes referred to as a source line SLx. The pixel units P11 to Pnm and the pixel switches M11 to Mnm are provided at the respective intersections of the gate lines GL1 to GLn and the source lines SL1 to SLm.

The pixel switches M11 to Mnm are controlled so as to be turned ON or OFF according to the gate signals Vg1 to Vgn supplied from the gate drivers 13.

The pixel units P11 to Pnm receive gradation voltage signals Vd1 to Vdm corresponding to the image data from the source drivers 14-1 to **14-*p*. When each of the pixel switches M11 to Mnm is ON, the gradation voltage signal Vd1 to Vdm is supplied to each pixel electrode of the pixel units P11 to Pnm, thereby charging each of the pixel electrodes. Display is performed by controlling the luminance of the pixel units P11 to Pnm according to the gradation voltage signals Vd1 to Vdm in the pixel electrodes of the pixel units P11 to Pnm. In the description below, a given gradation voltage signal among the gradation voltage signals Vd1** to Vdm is sometimes referred to with the reference character Vdx.

If the display device 100 is a liquid crystal display device, each of the pixel units P11 to Pnm includes a transparent electrode (not shown), and liquid crystal that is sealed between the semiconductor substrate and an opposite substrate that is provided so as to oppose the semiconductor substrate and on which one transparent electrode that covers the entire surface thereof is formed. Display is performed by changing the transmittance of the liquid crystal for a backlight inside the display device according to the potential difference between the gradation voltage signals Vd1 to Vdm supplied to the pixel units P11 to Pnm and the opposite substrate voltage.

The display controller 12 generates an image data signal VDS including a sequence of pixel data pieces PD (also referred to as image data pieces PD) in which the luminance level of each pixel is represented by 256 luminance gradations of 8 bits, for example, on the basis of the image data VD. The image data signal VDS is configured as an image data signal that was serialized according to the number of transmission paths in each of a prescribed number of source lines.

In the present embodiment, by forming a serial sequence of n pixel data piece groups, each of which includes m pixel data pieces PD, one frame of the image data signal VDS is formed. Each of the n pixel data piece groups includes pixel data pieces corresponding to the gradation voltage signals supplied respectively to n pixel columns constituted of the pixel units disposed along each of gate lines GL1 to GLn. Through operation of the source drivers 14-1 to 14-*p*, the gradation voltage signals Vd1 to Vdm to be supplied to the n×m pixel units (that is, the pixel units P11 to Pnm) are generated on the basis of the m×n pixel data pieces PD.

Also, the display controller 12 generates a clock signal CLK of an embedded clock mode in which the clock pulse period (hereinafter referred to as a clock period) is constant. Additionally, the display controller 12 integrates the clock signal CLK together with the image data signal VDS to form a serial signal that is supplied to the source drivers 14-1 to 14-*p* to control the display of the image data.

Also, the display controller 12 supplies a gate timing signal GS to the gate drivers 13A and 13B provided on both ends of the display panel 11.

The gate drivers 13A and 13B supply the gate signals Vg1 to Vgn to the gate lines GL1 to GLn on the basis of the gate timing signal GS supplied from the display controller 12. The pixel units P11 to Pnm of each pixel row are selected according to the supply of the gate signals Vg1 to Vgn. By the gradation voltage signals Vd1 to Vdm being supplied from the source drivers 14-1 to 14-*p* to the selected pixel units, the gradation voltage signals Vd1 to Vdm are written to the pixel electrodes.

The source drivers 14-1 to 14-*p* are each provided for a prescribed number of source lines that are grouped by dividing the source lines SL1 to SLm. The number of source lines driven by each source driver corresponds to the output channel count of the source driver. For example, if each source driver has an output channel count of 960, then if the display panel has one source line per pixel column, the source lines are driven by 12 source drivers in the case of a 4K panel and 24 source drivers in the case of an 8K panel. In the present embodiment, the description below is made with an example in which each of the source drivers 14-1 to 14-*p* drives k source lines (k being an integer of 2 or greater and less than m) (that is, when the output channel count is k). Each of the source drivers 14-1 to 14-*p* is formed in a semiconductor IC (integrated circuit) chip.

The source drivers 14-1 to 14-*p* receive, from the display controller 12, a serial signal formed by integrating the image data signal VDS and the clock signal CLK from the display controller 12 along separate transmission paths. The image data signal VDS and the clock signal CLK fork channels, which is the number of output channels for each of the source drivers 14-1 to 14-*p*, are supplied as a serialized differential signal to the source drivers 14-1 to 14-*p* during each data period.

Figure 2:
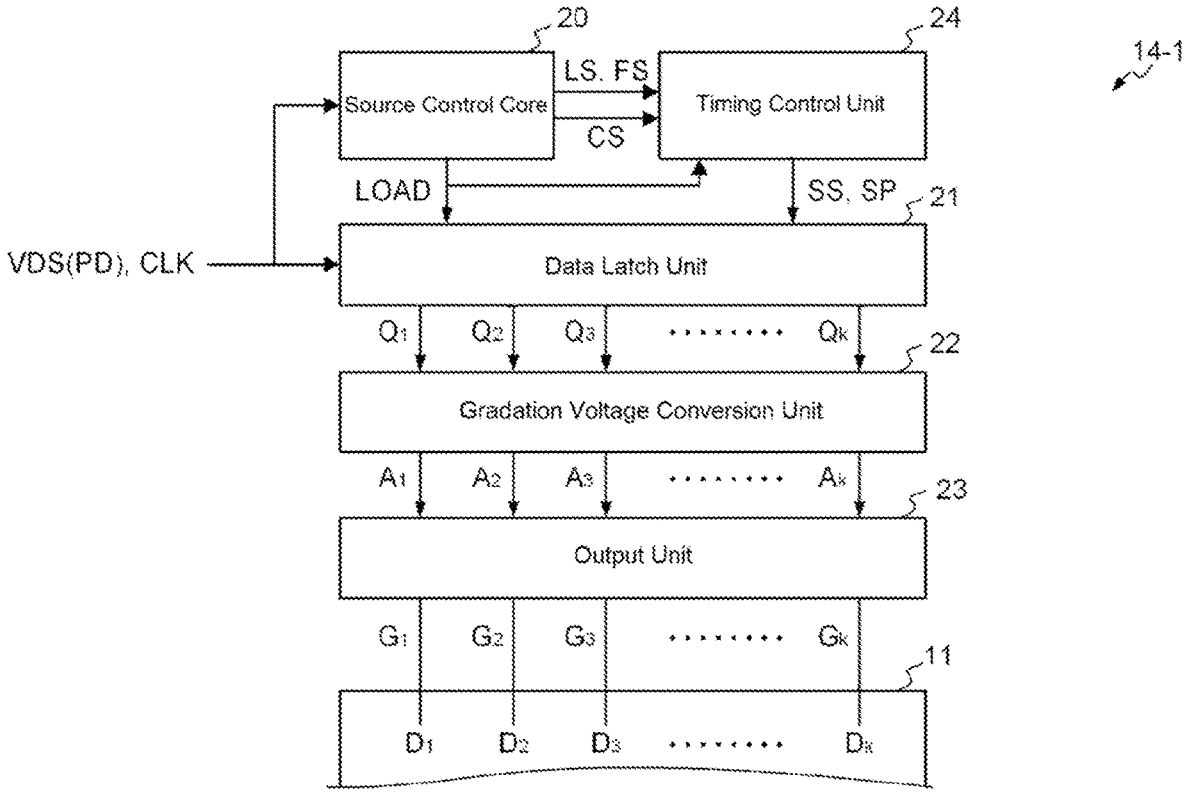
FIG. 2 is a block diagram showing the internal configuration of a source driver according to the present invention.

FIG. 2 is a block diagram showing the internal configuration of the source driver 14-1. The other source drivers 14-2 to 14-*p* have a similar configuration. The source driver 14-1 has a source control core 20, a data latch unit 21, a gradation voltage conversion unit 22, an output unit 23, and a timing control unit 24.

The source control core 20 performs control for supply of a load signal LOAD to the data latch unit 21 and acquisition of the image data by the data latch unit 21 (that is, acquiring sequence of pixel data pieces PD from the image data signal VDS). Also, the source control core 20 controls the timing control unit 24, which is a circuit block that controls the timing of data output from the data latch unit 21.

The data latch unit 21 sequentially acquires the sequence of pixel data pieces PD included in the image data signal VDS supplied from the display controller 12. At this time, the data latch unit 21 acquires the pixel data pieces PD according to control by the source control core 20.

Also, the data latch unit 21 outputs, to the gradation voltage conversion unit 22, the acquired pixel data pieces PD as pixel data Q1 to Qk according to the acquisition of the pixel data pieces PD corresponding to the output channel count of the source driver 14-1 (that is, k channels). The data latch unit 21 has k output terminals that correspond to the source lines SL1 to SLk driven by the source driver 14-1, and outputs the pixel data Q1 to Qk from the k output terminals. At this time, the data latch unit 21 outputs the pixel data Q1 to Qk at a timing according to control by the timing control unit 24.

The gradation voltage conversion unit 22 converts the pixel data Q1 to Qk supplied from the data latch unit 21 to the gradation voltages A1 to Ak having voltage values corresponding to the luminance gradations represented by the pixel data, and outputs the gradation voltages to the output unit 23.

The output unit 23 generates signals formed by amplifying the gradation voltages A1 to Ak as the gradation voltage signals Vd1 to Vdk, and supplies the gradation voltage signals to the source lines SL1 to SLk.

The timing control unit 24 performs control of the output timing of the pixel data Q1 to Qk by the data latch unit 21.

Figure 3:
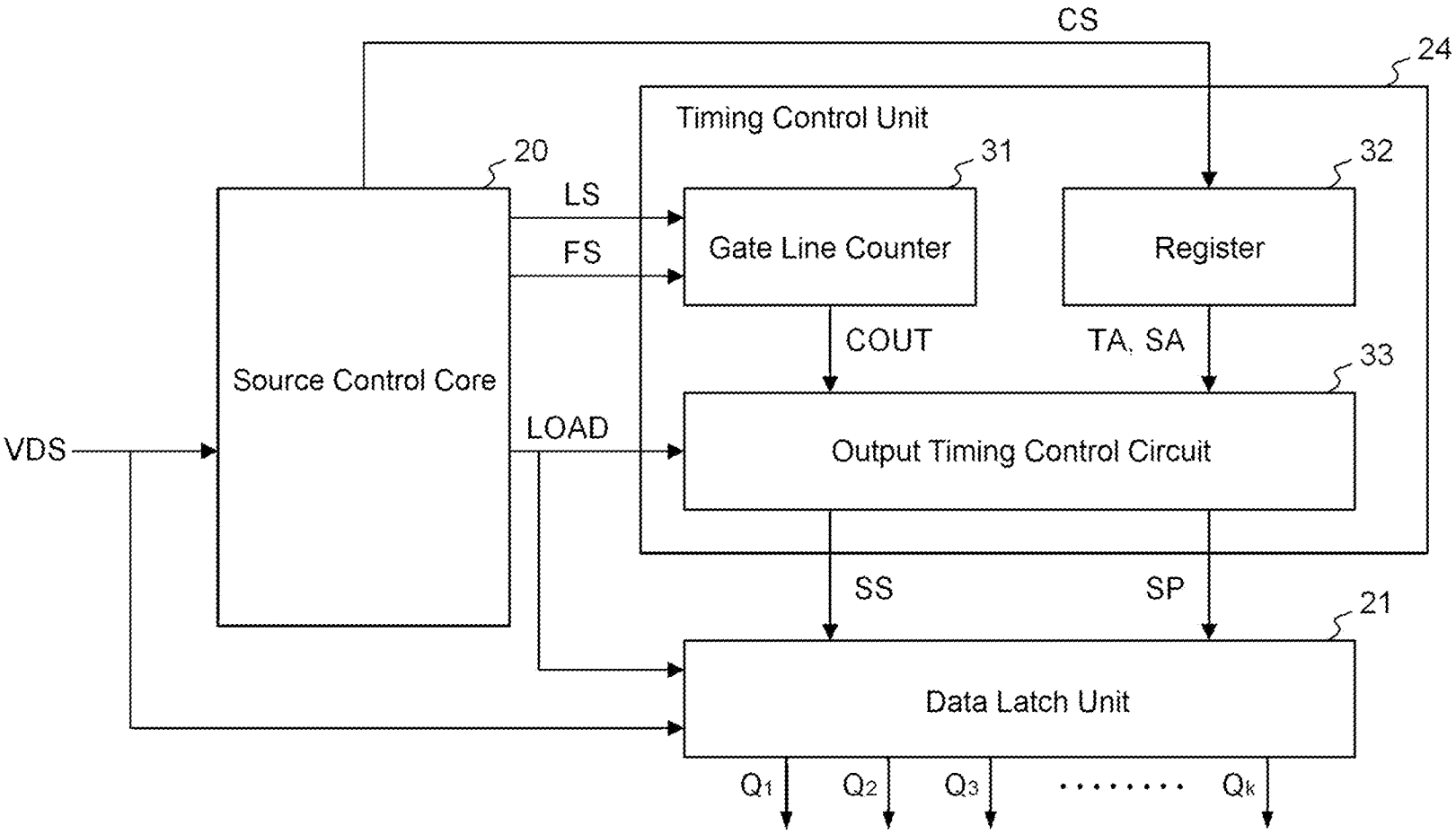
FIG. 3 is a block diagram that shows the internal configuration of a timing control unit of Embodiment 1 along with a source control core and a data latch unit.

FIG. 3 is a block diagram that shows the internal configuration of the timing control unit 24 along with the source control core 20 and the data latch unit 21. The timing control unit 24 includes a gate line counter 31, a register 32, and an output timing control unit 33.

The source control core 20 controls the timing control unit 24 on the basis of the image data signal VDS supplied from the display controller 12 and general-purpose setting information CS read from the register 32. The source control core 20 detects the timing for each horizontal scanning line (that is, gate line) of a sequence of pixel data pieces PD included in the image data signal VDS, and supplies a signal indicating the timing as a line signal LS to the gate line counter 31. Also, the source control core 20 detects the timing for each frame (that is, each screen displayed in the display panel 11) of a sequence of pixel data pieces PD included in the image data signal VDS, and supplies a signal indicating the timing as a frame signal FS to the gate line counter 31.

Also, the source control core 20 generates the load signal LOAD on the basis of the timing of each horizontal scanning line of the pixel data pieces PD included in the image data signal VDS, and supplies the load signal to the output timing control unit 33 and the data latch unit 21.

The gate line counter 31 performs counting on the basis of the frame signal FS and the line signal LS supplied from the source control core 20 and outputs the count value as a counter output COUT. The line signal LS is a signal representing the timing of each horizontal scanning line (that is, gate line) of the sequence of pixel data pieces PD included in the image data signal VDS, and thus, the counter output COUT by the gate line counter 31 is a value indicating the result of counting, for each gate line, the pixel data pieces PD included in the image data signal VDS.

The gate line counter 31 supplies the counter output COUT to the output timing control unit 33. As a result, the output timing control unit 33 is notified of the gate line to which each of the pixel data pieces PD included in the image data signal VDS is to be outputted as display data.

The register 32 stores various setting information pertaining to source output from the source driver 14-1. The register 32 stores, as the general-purpose setting information CS, information regarding the drive order of the source lines by the source driver 14-1 (that is, the order in which the gradation voltage signal Vd is supplied in the horizontal direction of the display panel 11), and the order by which the gradation voltage signal Vd is supplied to the intersections between the source line and the gate lines (that is, the drive order for the gradation voltage signal Vd in the vertical direction of the display panel 11), for example.

In the present embodiment, the source driver 14-1 drives the source lines SL1 to SLk in order from the source line closest to the gate driver 13A (that is, from SL1 to SLk), for example. Also, the source driver 14-1 of the present embodiment supplies the gradation voltage signals Vd1 to Vdk in order from the pixel unit on the gate line GL1 closest to the source driver 14-1 to the pixel unit on the gate line GLn farthest from the source driver 14-1 (that is, from GL1 to GLn), among the pixel units positioned at the intersections of each source line and the gate lines GL1 to GLn. Such information is stored in the register 32 as the general-purpose setting information CS.

Also, the register 32 stores timing adjustment setting information TA. The timing adjustment setting information TA is setting information for adjusting the timing of the source output from the source driver 14-1 (that is, the supply of the gradation voltage signals Vd1 to Vdk to the pixel units on the source lines SL1 to SLk) according to the intersecting position with the gate lines GL1 to GLn.

In the present embodiment, regarding the supply of the gradation voltage signal Vd1 to the pixel units disposed along the source line SL1 (that is, the pixel units at the intersecting positions with the gate lines GL1 to GLn), for example, the timing is adjusted such that the time interval for supply of the gradation voltage signal Vd1 is increasingly shortened from the pixel unit on the gate line GL1, which is closest to the source driver 14-1, to the pixel unit on the gate line GLn, which is farthest from the source driver 14-1.

More specifically, in the present embodiment, by controlling the output timing for the pixel data Q1 to Qk from the data latch unit 21 to the gradation voltage conversion unit 22, the output timing for the gradation voltage signal to the pixel units P11 to Pnk is adjusted. The k pixel data pieces PD for each line acquired by the data latch unit 21 correspond to the gradation voltage signals to be supplied to the k pixel units (hereinafter referred to as pixel columns) for each line disposed along the gate line. The acquisition of the pixel data pieces PD by the data latch unit 21 is performed at a uniform time interval. Thus, in the present embodiment, the timing is adjusted such that the longer the source line is from the source driver to the pixel column, the smaller the difference is between the timing at which the pixel data pieces PD are acquired by the data latch unit 21 and the timing at which the pixel data Q1 to Qk is outputted. The setting information for performing such timing adjustment is stored in the register 32 as the timing adjustment setting information TA.

Also, the register 32 stores spread adjustment setting information SA. The spread adjustment setting information SA is setting information for adjusting the difference in output timing from the source output to the first channel of the source driver 14-1 to the source output to the last channel (that is, the timing difference between the supply of the gradation voltage signal Vd1 to the pixel unit on the source line SL1 and the supply of the gradation voltage signal Vdk to the pixel unit on the source line SLk, among the pixels on the intersection points between the gate lines GL1 to GLn and the source lines SL1 to SLk).

In the present embodiment, the timing is adjusted such that the time interval at which the gradation voltage signals are supplied between adjacent channels is expanded according to the distance from the gate driver 13A such that the time interval for supply of the gradation voltage signals Vd1 to Vdk is increased from the first channel to the last channel, transitioning from the pixel unit on the closest source line SL1 from the source driver 14-1 to the pixel unit on the farthest source line SLk from the gate driver 13A.

More specifically, in the present embodiment, the output timing for the data latch unit 21 is adjusted such that the longer the gate line is from the gate driver to each of the pixel units of the pixel column, the greater the difference is between the timing for outputting the pixel data to be supplied to one pixel unit of the pixel column and the timing for outputting the pixel data to be supplied to another pixel unit adjacent to the one pixel unit. As a result, the time difference between the timings for outputting the pixel data corresponding to the adjacent pixel units of the pixel column becomes greater as the distance from the gate driver increases, and as a result, the time interval for supplying the gradation voltage signals between adjacent channels increases as the distance from the gate driver 13A increases. The setting information for performing such timing adjustment is stored in the register 32 as the spread adjustment setting information SA.

Also, the register 32 stores setting information for adjusting the timing for source output in adjacent sections of the source drivers 14-1 and 14-2. That is, in the present embodiment, supply of the gradation voltage signals Vd1 to Vdm to the source lines SL1 to SLm is split among the source drivers 14-1 to **14-*p*. Thus, there is a need to perform timing adjustment such that output from the last channel of a source driver and output from the first channel of the adjacent source driver are smooth and continuous. Information pertaining to the control of the output timing for the pixel data Q1 to Qk from the data latch unit 21 to perform such timing adjustment is stored in the register 32** as setting information.

The output timing control unit 33 generates a source output start signal SS on the basis of the load signal LOAD supplied from the source control core 20 and the timing adjustment setting information TA read from the register 32, and supplies the source output start signal to the data latch unit 21. The source output start signal SS is a signal indicating the timing at which to start source output from the first channel of the source driver 14-1. In reality, the timing control unit 24 is a circuit for controlling the data latch unit 21, and thus, the output of the pixel data Q1 to Qk from the data latch unit 21 to the gradation voltage conversion unit 22 is started on the basis of the source output start signal SS. On the basis thereof, the output of the gradation voltages A1 to Ak from the gradation voltage conversion unit 22 to the output unit 23 and the output of the gradation voltage signals Vd1 to Vdk from the output unit 23 are performed sequentially.

Also, the output timing control unit 33 generates a spread setting signal SP on the basis of the timing adjustment setting information TA and a spread adjustment setting information SA read from the register 32, and supplies the spread setting signal to the data latch unit 21. The spread setting signal SP is a setting signal for setting the output timing for the pixel data Q1 to Qk from the data latch unit 21 for each line (that is, for each gate line).

The data latch unit 21 acquires a sequence of the pixel data pieces PD from the image data signal VDS on the basis of the clock signal CLK, and confirms acquisition of one line of the pixel data pieces PD (that is, k pixel data pieces PD) on the basis of the load signal LOAD supplied from the source control core 20. The data latch unit 21 starts output of the pixel data Q1 according to the source output start signal SS from the output timing control unit 33 and outputs the pixel data Q2 to Qk at a timing set by the spread setting signal SP.

Next, the operation of the source driver 14-1 of the present embodiment will be described with reference to the timing chart of FIG. 4.

The source control core 20 receives the supply of the image data signal VDS from the display controller 10, detects the initial position for a frame in the sequence of pixel data pieces PD included in the image data signal VDS, and supplies to the gate line counter 31 the frame signal FS indicating the start of the pixel data pieces PD of one frame. The frame signal FS is, as shown in FIG. 4, a binary signal that indicates by one pulse, for example, the initial position of the pixel data pieces PD for each frame.

Also, the source control core 20 detects the initial position of the pixel data pieces PD for each line (that is, each gate line) included in the image data signal VDS, and supplies to the gate line counter 31 the line signal LS indicating the initial position. The line signal LS is, as shown in FIG. 4, a binary signal that indicates by one pulse the initial position of the pixel data pieces PD for each line.

Also, the source control core 20 generates the load signal LOAD on the basis of the image data signal VDS, and supplies the load signal to the output timing control unit 33 and the data latch unit 21. The load signal LOAD is, as shown in FIG. 4, a binary signal that indicates by one pulse the acquisition period at a fixed interval corresponding to the pixel data pieces PD for each line.

The gate line counter 31 performs counting on the basis of the line signal LS and outputs the counter output COUT indicating the count value. If the number of gate lines GL1 to GLn is 4320 (that is, n=4320), for example, then as shown in FIG. 4, the value of the counter output increases for each pulse of the line signal LS from 0 to 4319.

The output timing control unit 33 supplies, to the data latch unit 21, the spread setting signal SP on the basis of the timing adjustment setting information TA and the spread adjustment setting information SA read from the register 32. As a result, setting of the output timing of the pixel data Q1 to Qk by the data latch unit 21 is switched. As shown in FIG. 4, for example, switching of the setting of the sequence of pixel data pieces PD is performed for every two lines (that is, every two gate lines).

The output timing control unit 33 supplies, to the data latch unit 21, the source output start signal SS on the basis of the load signal LOAD and the timing adjustment setting information TA read from the register 32. The source output start signal SS is a binary signal, indicating by one pulse, for example, the start of the source output for each line.

The source output start signal SS delays the change in signal level of the load signal LOAD to change the signal level. The time difference for the signal change between the source output start signal SS and the load signal LOAD (hereinafter referred to as the delay time for the source output start signal SS) changes according to the distance between the source driver 14-1 and the line to which the source output start signal SS corresponds.

In the present embodiment, for example, as described above, the timing difference is set such that the longer the source line is from the source driver 14-1 to the pixel column (that is, the pixel unit for one line disposed along the gate line), the smaller the difference is between the timing at which the pixel data pieces PD are acquired by the data latch unit 21 and the timing at which the pixel data Q1 to Qk is outputted. Thus, regarding the supply of the gradation voltage signals Vd1 to Vdk that are the source output as well, the time difference compared to the load signal LOAD is shortened the longer the source line is from the source driver 14-1 to the pixel unit. Thus, as shown in FIG. 4, in the first line (gate line GL1, count 0), the delay time of the source output start signal SS is long, and the delay time of the source output start signal SS progressively shortens towards the last line (gate line GLn, count 4319).

The data latch unit 21 outputs the pixel data Q1 corresponding to the first channel (that is, the source line SL1) of the source driver 14-1 at a timing based on the change in signal level of the source output start signal SS. In FIG. 4, the binary signal representing the timing of the output of the pixel data Q1 is indicated as the source output "SOUT (Chip First Channel)."

The data latch unit 21 sequentially performs output of the pixel data Q1 to Qk from the pixel data Q1 that is the pixel data corresponding to the first channel of the source driver 14-1 to the pixel data Qk corresponding to the last channel (that is, the source line SLk). In this case, the data latch unit 21 changes the time interval between outputs of the respective channels from the first channel to the last channel to two lines of pixel data Q1 to Qk (that is, pixel data Q1 to Qk for every two gate lines) according to the setting by the spread setting signal SP.

In the present embodiment, for example, as described above, the timing is set such that the longer the source line is from the source driver 14-1 to the pixel column (that is, the pixel unit for one line disposed along the gate line), the greater the timing difference is for the output from the data latch unit 21 of the pixel data corresponding to the gradation voltage signal to be supplied to an adjacent pixel. Thus, regarding the supply of the gradation voltage signals Vd1 to Vdk that are the source outputs as well, the time difference of the supply timing among adjacent channels is lengthened the longer the source line is from the source driver 14-1 to the pixel unit. Thus, the time interval from the output of the first channel to the output of the last channel is also set to be greater according to the distance from the source driver 14-1. As a result, as indicated in FIG. 4 as the source output "SOUT (Chip Last Channel)," in the first line (gate line GL1, count 0), the time difference between the output of the pixel data Q1 corresponding to the first channel and the output of the pixel data Qk corresponding to the last channel is small, and the time difference increases progressively towards the last line (gate line GLn, count 4319).

Thus, in the source driver 14-1 of the present embodiment, the timing of the output of the pixel data Q1 to Qk from the data latch unit 21 is adjusted, and as a result, the timing for supply of the gradation voltage signals Vd1 to Vdk from the source driver 14-1 to the pixel unit is adjusted. Also, a similar timing adjustment is performed for the source drivers 14-2 to **14-*p*. As a result of this timing adjustment, it is possible to set the pixel charging rate to be uniform for the pixel units P11 to Pnm. This will be described with reference to FIGS. 5 and 6**.

Figure 5:
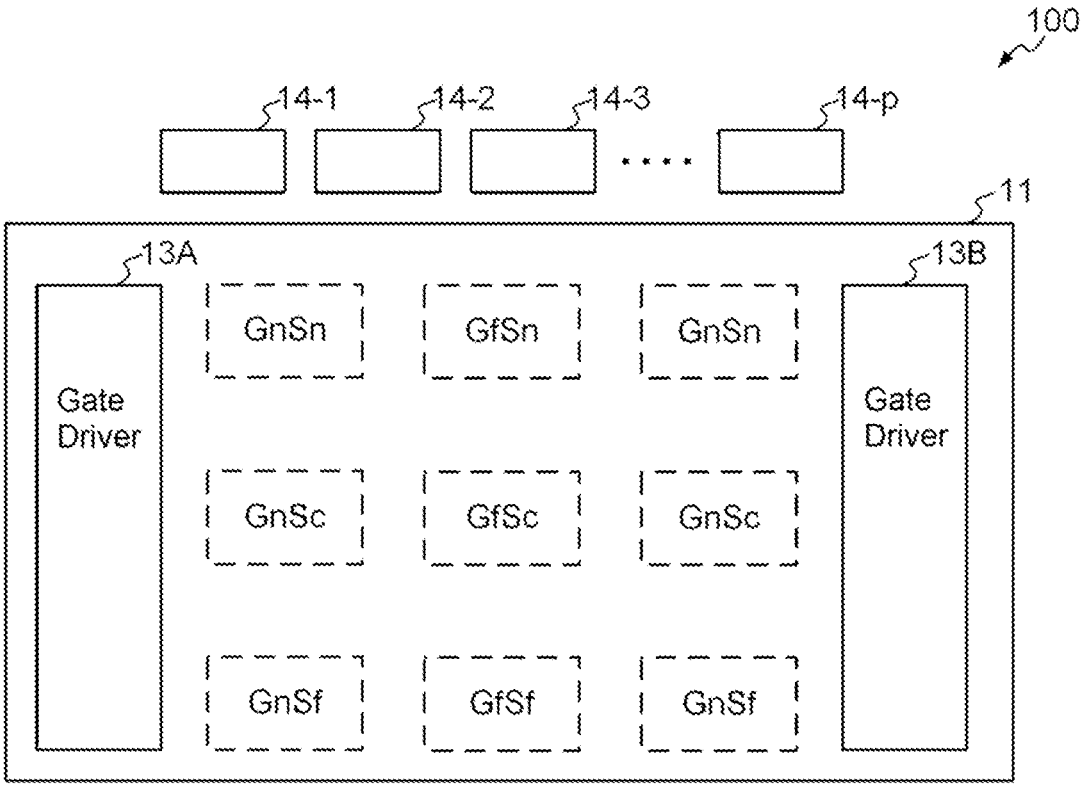
FIG. 5 schematically shows pixel areas on the display panel according to the distance from gate drivers and source drivers.

FIG. 5 schematically shows pixel positions on the display panel according to the distance from the gate drivers 13A and 13B and the source drivers 14-1 to 14-*p*.

A region of the pixel units that is close to the gate driver 13A or 13B and close to the source drivers 14-1 to 14-*p* is indicated as "GnSn." A region of the pixel units that is far from the gate driver 13A or 13B and close to the source drivers 14-1 to 14-*p* is indicated as "GfSn." A region of the pixel units that is close to the gate driver 13A or 13B and at mid-distance from the source drivers 14-1 to 14-*p* (that is, near the center of the display panel 11) is indicated as "GnSc." A region of the pixel units that is far from the gate driver 13A or 13B and at mid-distance from the source drivers 14-1 to 14-*p* (that is, near the center of the display panel 11) is indicated as "GfSc." A region of the pixel units that is close to the gate driver 13A or 13B and far from the source drivers 14-1 to 14-*p* is indicated as "GnSf." A region of the pixel units that is far from the gate driver 13A or 13B and far from the source drivers 14-1 to 14-*p* is indicated as "GfSf."

Figure 6:
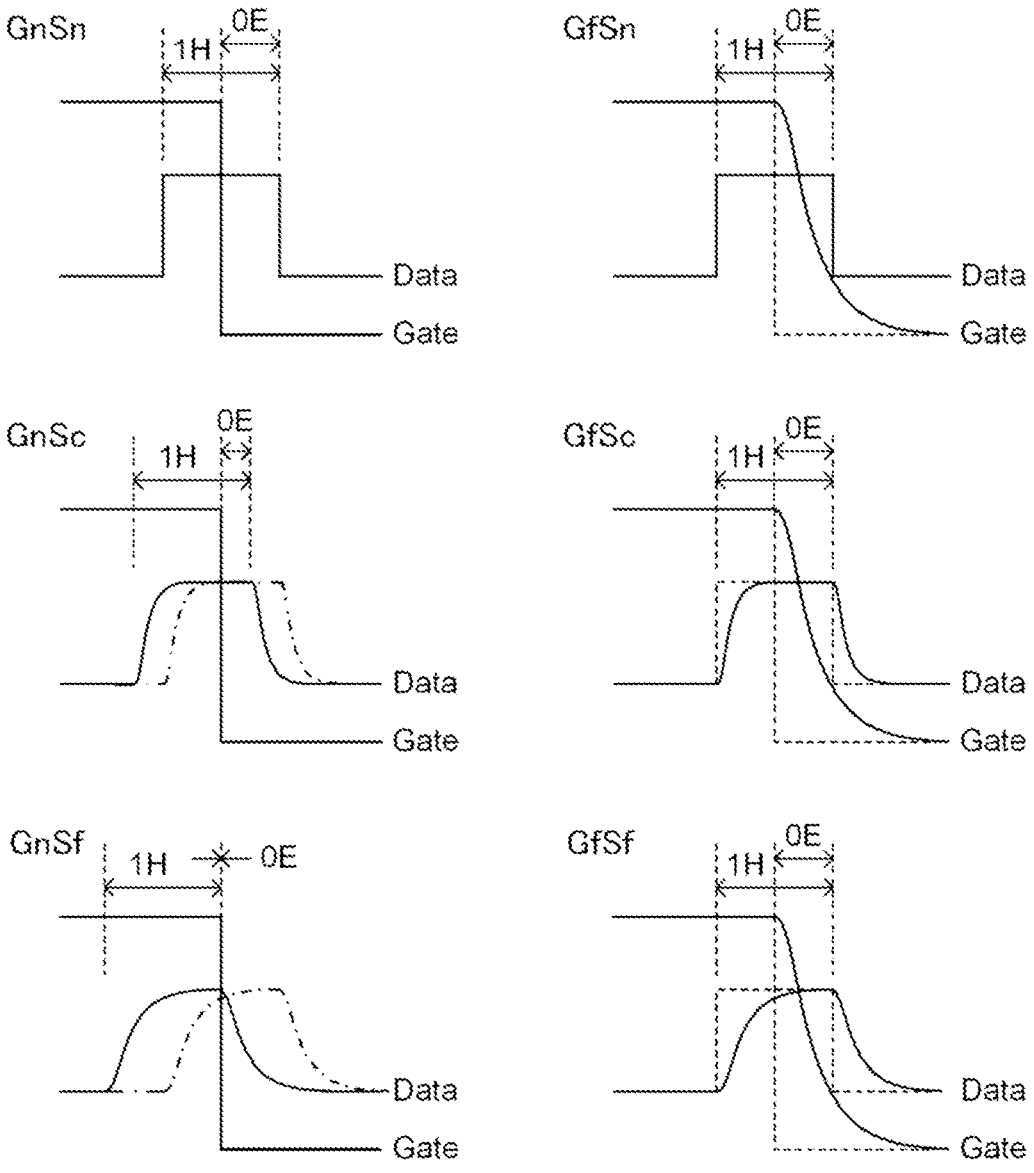
FIG. 6 shows signal waveforms of the gate signal and the gradation voltage signal of Embodiment 1 in each of the pixel areas of FIG. 5.

FIG. 6 shows signal waveforms of the gate signal and the gradation voltage signal in each of the pixel areas of FIG. 5. In the drawing, "1H" indicates a period during which the signal level of the gradation voltage signal is at an H level, and "0E" indicates an offset period for writing. The gate signals of FIG. 6 are examples of signal waveforms in which a gate selection period (high level period) during which a selected pixel unit is pre-charged (so-called gate pre-charging) is long, and the rising portions of the gate signals are omitted.

At GnSn, the distance from the gate driver 13A or 13B is close and the effect of impedance on the gate lines is small, and thus, there is little (or almost no) reduction in sharpness of the fall of the signal waveform of the gate signal (indicated as "Gate" in the drawing). Also, the distance from the source drivers 14-1 to 14-*p* is close and the effect of impedance on the source lines is small, and thus, there is little (or almost no) reduction in sharpness of the rise and fall of the signal waveform of the gradation voltage signal (indicated as "Data" in the drawing).

By contrast, at GnSc, the distance from the gate driver 13A or 13B is close, and thus, there is little (or almost no) reduction in sharpness of the signal waveform of the gate signal, but the distance from the source drivers 14-1 to 14-*p* is far compared to GnSn, and thus, the effect of impedance on the source lines is present, and there is a reduction in sharpness of the rise and fall of the signal waveform of the gradation voltage signal.

Also, at GnSf, there is little (or almost no) reduction in sharpness of the signal waveform of the gate signal, but the distance from the source drivers 14-1 to 14-*p* is even farther than GnSc, and the effect of impedance on the source lines is great, and thus, there is a great reduction in sharpness of the rise and fall of the signal waveform of the gradation voltage signal.

Figure 4:
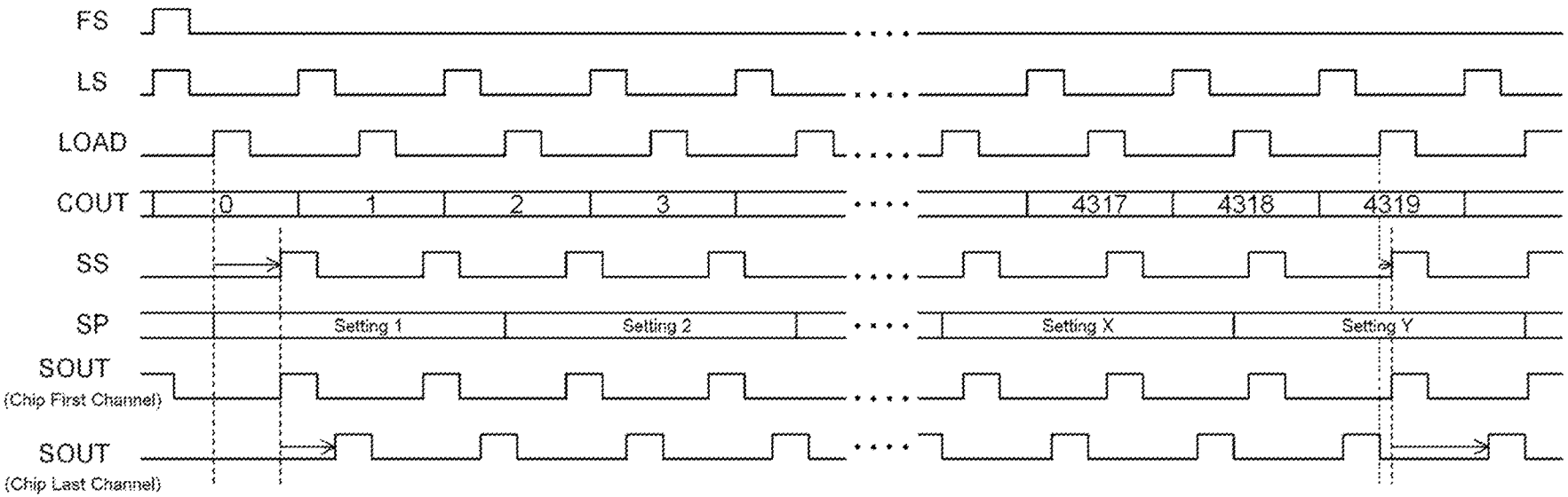
FIG. 4 is a timing chart showing the output timing of each signal resulting from the operation of the source driver of Embodiment 1.

In the present embodiment, as shown in FIG. 4, the delay time for the source output SOUT (that is, the time difference compared to the load signal LOAD) is set to be smaller as the value of the counter output COUT increases, that is, as the distance from the source driver to the gate lines increases. Thus, as shown in FIG. 6, the gradation voltage signal in GnSc is a signal waveform that changes at a faster timing than the gradation voltage signal in GnSn when considering the timing of the fall of the gate signal. Also, the gradation voltage signal in GnSf is a signal waveform that changes at an even faster timing when considering the timing of the fall of the gate signal.

If timing adjustment for the source output of the present embodiment were not performed, the signal waveform of the gradation voltage signal in GnSf would be the signal waveform indicated by the one-dot chain line in GnSc and GnSf of FIG. 6. Thus, in GnSf, the gate signal falls before the gradation voltage signal sufficiently rises, preventing sufficient charging of the pixel electrodes by the supply of the gradation voltage signals.

By contrast, by performing the timing adjustment in the source output as indicated in the present embodiment and setting the timing of the gradation voltage signal according to the gate signal to be faster, it is possible to charge the pixel electrodes when the signal waveform of the gradation voltage signal has risen sufficiently even in GnSf.

Also, in the present embodiment, as the value of the counter output COUT increases, that is, as the distance from the source driver to the gate lines increases, the time difference between channels of the source output SOUT is set to increase (that is, the time difference between the first channel and the last channel is set to be large). This is because, as indicated by GfSn, GfSc, and GfSf in FIG. 6, in pixel areas far from the gate driver 13A or 13B, the impedance on the gate line results in a greater reduction in sharpness of the fall in the signal waveform of the gate signal.

That is, in pixel areas far from the gate driver 13A or 13B, the reduction in sharpness of the rise and fall of the signal waveform of the gradation voltage signal increases as the distance from the source driver increases, but the reduction in sharpness in the fall of the signal waveform of the gate signal is also large. Thus, the effect on the charging of the pixel electrodes of the reduction in sharpness of the rise and fall of the signal waveform of the gradation voltage signal is not as great as in pixel areas close to the gate driver 13A or 13B.

That is, in the pixel areas GfSn, GfSc, and GfSf, which are far from the gate drivers 13A and 13B, unlike pixel areas that are close to the gate drivers 13A and 13B, even if the distance from the source driver to the gate lines is far, there is no need to set the timing of the gradation voltage signal to be faster. Thus, as shown in FIG. 4, by controlling the time difference between the channels of the source output SOUT to be greater as the distance from the source driver to the gate lines increases, adjustment is performed such that the timings of the gradation voltage signals in the pixel areas farther from the gate driver 13A and 13B match.

As described above, in the source drivers 14-1 to 14-*p* of the present embodiment, in pixel areas close to the gate driver 13A or 13B, adjustment is performed such that the greater the distance from the source drivers is, the faster the timing of the gradation voltage signal is set in relation to the gate signal. As a result, even if a reduction in sharpness occurs in the signal waveform of the gradation voltage signal as a result of impedance in the source line, it is possible to sufficiently charge the pixel electrodes.

On the other hand, in pixel areas far from the gate driver 13A or 13B, a reduction in sharpness of the signal waveform of the gradation voltage signal occurs due to impedance in the source line if the distance from the source driver is far, but there is also a reduction in sharpness of the signal waveform of the gate signal as a result of impedance in the gate line. Thus, in the source drivers 14-1 to 14-*p* of the present embodiment, timing adjustment is performed such that the gradation voltage signal rises at the same timing regardless of how close or far the distance from the source drivers is. As a result, even in pixel areas far from the gate driver 13A or 13B, it is possible to sufficiently charge the pixel electrode regardless of the distance from the source driver. As a result, the occurrence of uneven luminance resulting from a decrease in writing voltage is mitigated.

Embodiment 20

Next, Embodiment 2 of the present invention will be explained. A display device of Embodiment 2 differs from the display device 100 of Embodiment 1 in terms of the internal configuration and operation of the timing control unit 24 of the source driver ICs. In the description below, the IC constituting the source driver 14-1 is referred to as IC1, and the IC constituting the source driver 14-*y*, which is located midway among the source drivers 14-1 to 14-*p*, is referred to as ICy.

Figure 7:
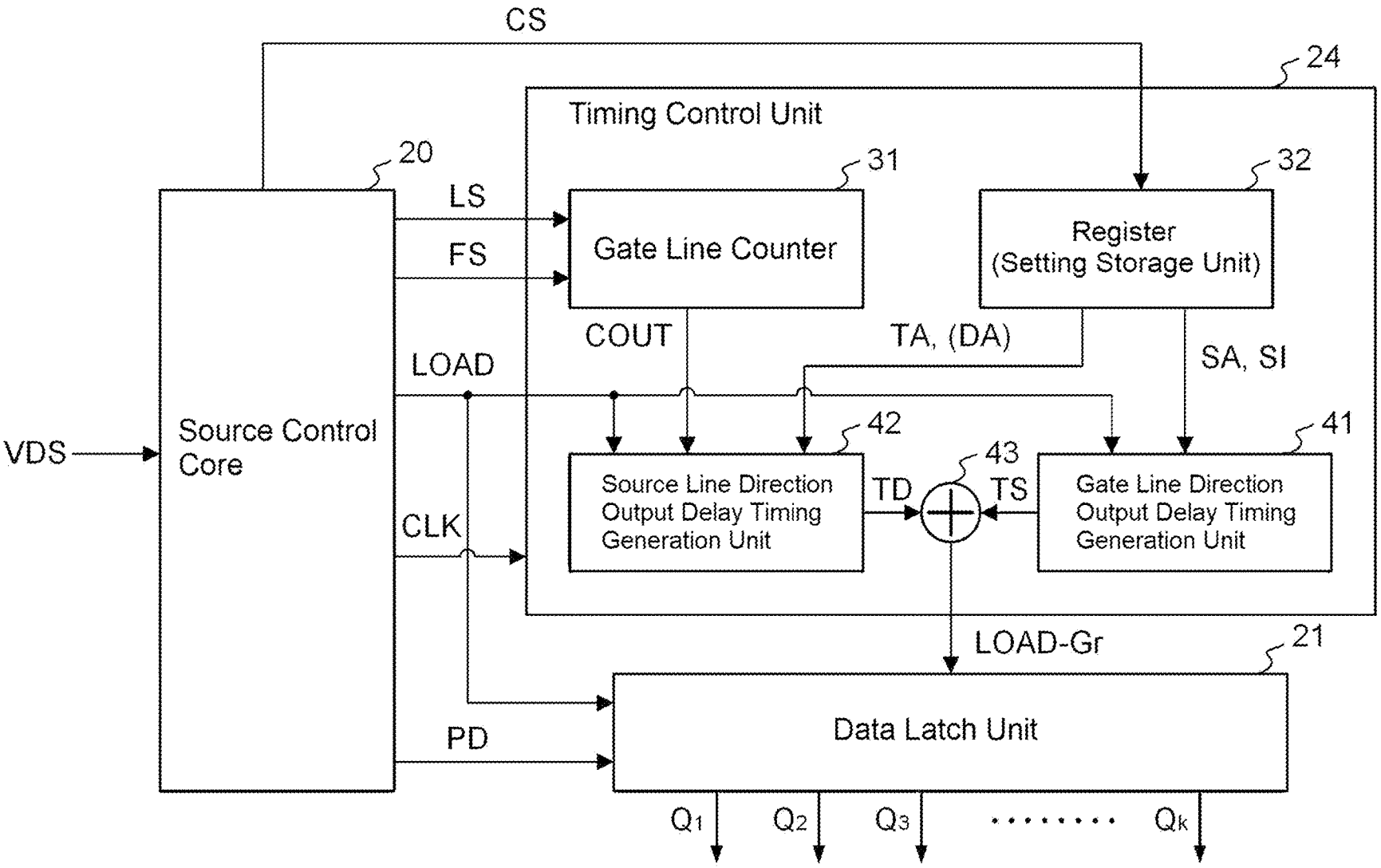
FIG. 7 is a block diagram that shows the internal configuration of a timing control unit of Embodiment 2 along with a source control core and a data latch unit.

FIG. 7 is a block diagram that shows the internal configuration of the timing control unit 24 of the display device of Embodiment 2 along with the source control core 20 and the data latch unit 21. The timing control unit 24 has a gate line counter 31, a register 32, a gate line direction output delay timing generation unit 41, a source line direction output delay timing generation unit 42, and a setting signal addition unit 43.

The register 32 stores general-purpose setting information CS supplied from the source control core 20, timing adjustment setting information TA that is setting information for adjusting the output timing (delay amount) according to the source signal delay, spread adjustment setting information SA for adjusting the output timing (delay amount) among source lines according to the gate signal delay, and setting information SI indicating the timing (delay amount) for the source output start for the first channel (or last channel) of each source driver IC.

The spread adjustment setting information SA includes setting information for a delay amount OE among source outputs of the source driver ICs. The timing adjustment setting information TA includes setting information for a delay amount Ds according to the distance from the source drivers.

Also, the register 32 of the present embodiment stores split count setting information DA for the timing adjustment setting information TA. The split count setting information DA is setting information regarding the number of steps taken by each driver for setting the delay amount Ds according to the distance from the source drivers, or in other words, is information indicating the number of stages at which the setting of the output timing is switched along the lengthwise direction of the source lines (hereinafter referred to as source line direction). In the present embodiment, for example, information indicating that the setting is changed over Y steps (settings 1 to Y) for each output of the image data pieces corresponding to two gate lines is stored in the register 32 as the split count setting information DA.

The gate line direction output delay timing generation unit 41 generates an output timing setting signal TS for setting the delay time for source output according to the distance in the lengthwise direction of the gate lines (hereinafter referred to as gate line direction) on the basis of the spread adjustment setting information SA and the setting information SI read from the register 32. In the present embodiment, for example, a signal setting the source output timing such that the output delay for outputs from the source driver IC (IC1, for example) closest to the gate driver 13A or 13B is small and the output delay for a source driver IC (ICy, for example) farther from the gate driver 13A or 13B is large is generated as the output timing setting signal TS.

The source line direction output delay timing generation unit 42 generates an output timing setting signal TD for setting the delay time for source output according to the distance in the source line direction on the basis of the timing adjustment setting information TA and the split count setting information DA read from the register 32. In the present embodiment, for example, a signal for setting the delay time such that output delay for a source output to be supplied to pixels on a gate line close to each source driver IC is relatively large and the output delay for a source output to be supplied to pixels on a gate line far from each source driver IC is relatively small is generated as the output timing setting signal TD. In the present embodiment, the output timing setting signal TD is generated as the output timing setting signal TD that changes the output timing for every two gate lines on the basis of the split count setting information DA for changing the setting for every two gate lines.

The setting signal addition unit 43 adds the output timing setting signal TS and the output timing setting signal TD to generate an output timing signal LOAD-Gr. The output timing signal LOAD-Gr is an output timing signal group including the data output timing for a frame in each channel and the data output timing among channels from the latch unit.

The data latch unit 21 receives supply of the load signal LOAD from the source control core 20. The load signal LOAD is a timing signal of a 1H period based on the line signal LS, and is an acquisition timing signal for the data latch unit 21 to acquire the image data piece PD. Also, the load signal LOAD is a signal linked to the gate OFF timing that is a timing when the gate signals Vg1 to Vgn fall.

The data latch unit 21 acquires the image data piece PD on the basis of the timing of the load signal LOAD. The pixel data Q1 to Qk is outputted on the basis of the output timing signal LOAD-Gr.

Figure 8:
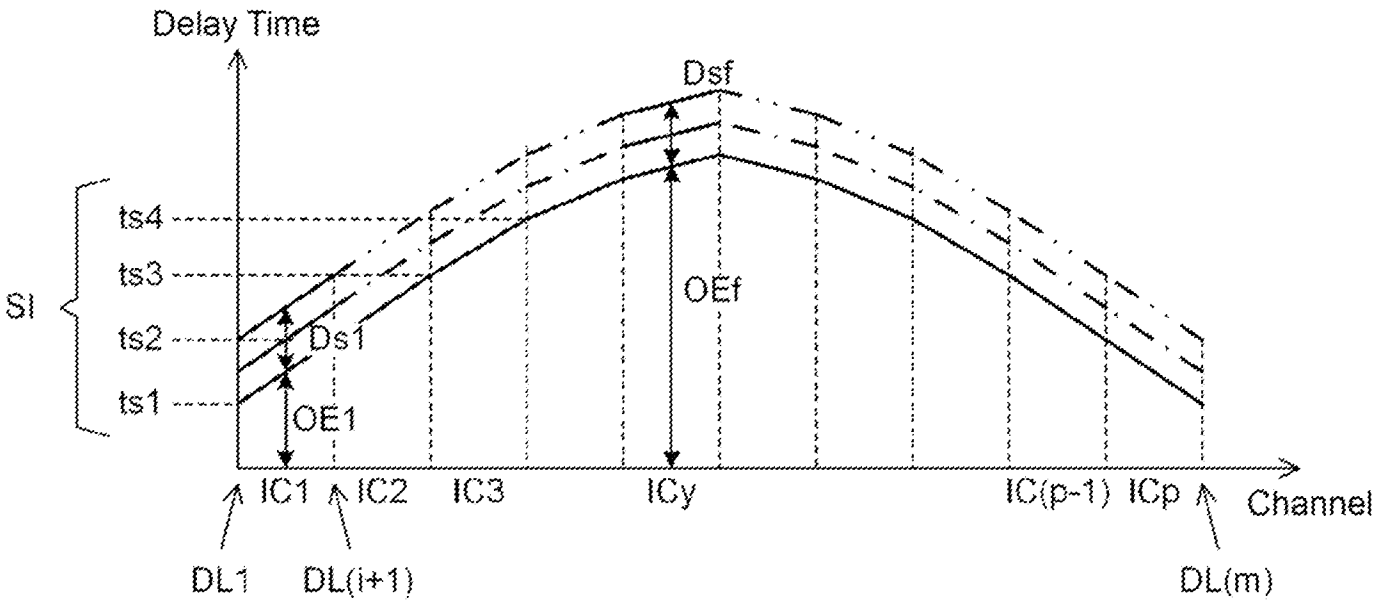
FIG. 8 is a conceptual drawing that shows an image of the setting of an output delay and the delay time of each source driver IC according to Embodiment 2.

FIG. 8 is a conceptual drawing that shows an image of the setting of an output delay and the delay time of each source driver IC according to the present embodiment.

The horizontal axis indicates the source output for each channel of the respective source driver ICs. The vertical axis indicates the delay amount for source output based on the load signal LOAD. Also, ts1, ts2, ts3, and ts4 indicate the start timing for source output of the first channel of each source driver IC (IC1, IC2, IC3, IC4) set on the basis of the setting information SI.

In IC1 (source driver 14-1), which is the closest source driver IC to the gate driver 13A, for example, the delay time based on the output delay in the gate line direction is set to the delay amount OE1 on the basis of the output timing setting signal TS. A delay amount Dsf based on the distance from the source driver is added to the delay amount OE1, and the resulting value is the delay time for source output of the IC1.

In ICy (source driver 14-*y*), which is the farthest source driver IC from the gate drivers 13A and 13B, the delay time based on the output delay in the gate line direction is set to the delay amount OEf on the basis of the output timing setting signal TS. A delay amount Dsf based on the distance from the source driver is added to the delay amount OEf, and the resulting value is the delay time for source output of the ICy.

The delay amount OE (OE1 to OEf) in the gate line direction is set, on the basis of the output timing signal LOAD-Gr, so as to change in stages for every prescribed channel from the first channel to the last channel of each IC as well.

Also, the delay amount Ds (Ds1 to Dsf) of each IC based on the distance from the source driver is set in three stages in each IC in the example of FIG. 8, but the delay amount may be set in any number of stages (number of steps) individually for each IC.

Figure 9:
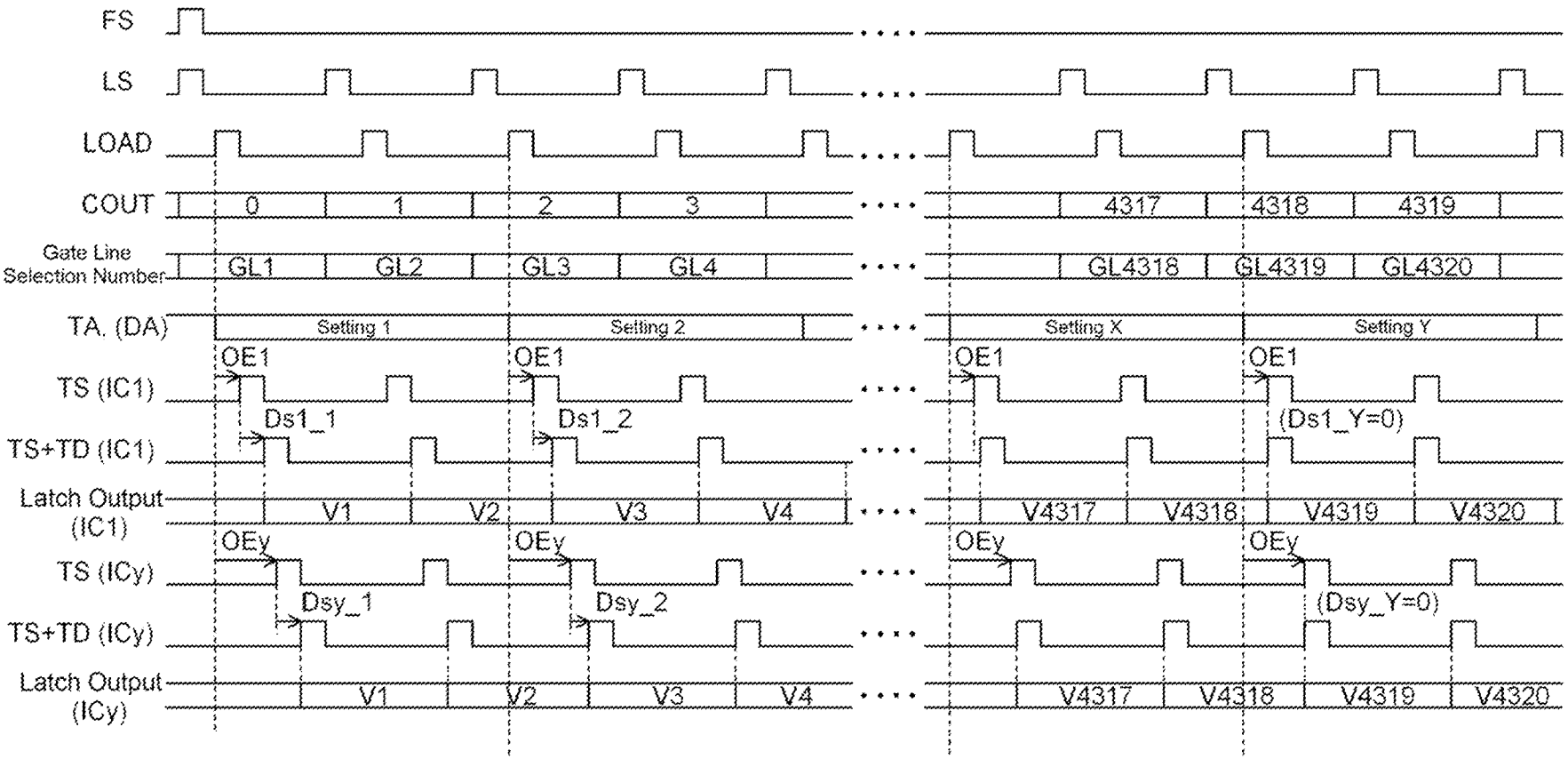
FIG. 9 is a timing chart showing the output timing for when source output is performed from the end closer to the source driver to the end farther from the source driver of Embodiment 2.

Next, the operation of the IC1 (source driver 14-1) and the ICy (source driver 14-*y*) of the present embodiment will be described with reference to the timing chart of FIG. 9. The timing chart of FIG. 9 shows a case in which the gradation voltage signals (that is, the source output) are supplied in a direction from the pixel unit on the near end of the source line, which is closest to the source driver, towards the pixel unit on the far end of the source line, which is farthest from the source driver.

The source control core 20 supplies to the gate line counter 31 the frame signal FS indicating the start of the image data pieces PD of one frame included in the image data signal VDS. Also, the source control core 20 supplies to the gate line counter 31 the line signal LS indicating the initial position of the image data piece PD for each 1H period. Additionally, the source control core 20 generates the load signal LOAD on the basis of the image data signal VDS, and supplies the load signal to the gate line direction output delay timing generation unit 41, the source line direction output delay timing generation unit 42, and the data latch unit 21.

The gate line counter 31 performs counting on the basis of the line signal LS and outputs the counter output COUT indicating the count value. If the number of gate lines is n=4320, then as shown in FIG. 9, the value of the counter output COUT increases for each pulse of the line signal LS from 0 to 4319.

The gate line to which the source output is to be supplied is selected according to the counter output COUT of the gate line counter 31. That is, if the gradation voltage signals Vd1 to Vdk are being supplied in a direction from the position on the gate line closest to the source driver (that is, the near end of the source line) to the position on the gate line farthest from the source driver (that is, the far end of the source line), then the gate lines to be supplied the source output are selected in the order of the gate lines GL1, GL2, GL3, GL4, . . . GL4318, GL4319, and GL4320.

The source line direction output delay timing generation unit 42 changes the setting of the delay amount Ds according to the distance from the source driver on the basis of the split count setting information DA and the timing adjustment setting information TA read from the register. In the present embodiment, the setting of the delay amount Ds is changed at each step for two gate lines. The source line direction output delay timing generation unit 42 generates the output timing setting signal TD including the setting of the delay amount Ds.

The gate line direction output delay timing generation unit 41 generates the output timing setting signal TS to set the delay amounts OE1 to OEy such that the delay time increases as the distance from the gate driver 13A increases. The delay amount of the source driver 14-1 (IC1) that is the source driver closest to the gate driver 13A is set to the delay amount OE1 and the delay amount of the source driver 14-*y* (ICy) that is the source driver farthest from the gate driver 13A is set to the delay amount OEy, for example. The relationship between the delay amounts OE1 to OEy is set as OE1<OE2 . . . <OEy.

The setting signal addition unit 43 adds the output timing setting signal TS generated by the gate line direction output delay timing generation unit 41 and the output timing setting signal TD generated by the source line direction output delay timing generation unit 42 to supply, to the data latch unit 21, the output timing signal LOAD-Gr, which is the result of the addition.

Regarding the source output of the source driver 14-1, for example, as indicated in FIG. 9 as "TS+TD (IC1)," the delay amount attained by adding the delay amount Ds1_1 to the delay amount OE1 is set as the delay time for output to the pixel units on the gate line GL1 and the pixel units on GL2. Also, the delay amount attained by adding the delay amount Ds1_2 to the delay amount OE1 is set as the delay time for output to the pixel units on the gate line GL3 and the pixel units on GL4. The setting of the delay time is performed similarly thereafter, with the delay amount attained by adding the delay amount Ds1_Y to the delay amount OE1 being set as the delay time for output to the pixel unit on the gate line GL4319 and the gate line GL4320.

Similarly, regarding the source output of the source driver 14-*y*, as indicated in FIG. 9 as "TS+TD (ICy)," the delay amount attained by adding the delay amount Dsy_1 to the delay amount OEy is set as the delay time for output to the pixel units on the gate line GL1 and the pixel units on GL2. Also, the delay amount attained by adding the delay amount Dsy_2 to the delay amount OEy is set as the delay time for output to the pixel units on the gate line GL3 and the pixel units on GL4. The setting of the delay time is performed similarly thereafter, with the delay amount obtained by adding the delay amount Dsy_Y to the delay amount OEy being set as the delay time for output to the pixel unit on the gate line GL4319 and the gate line GL4320.

The delay amount Ds is set so as to decrease as the distance from the source driver to each gate line increases, and thus, the relationship between the delay amounts is Ds1_1>Ds1_2> . . . >Ds1_Y. Also, Dsy_1>Dsy_2> . . . >Dsy_Y. In the present embodiment, the setting of the delay amount Ds is changed for every two gate lines.

The data latch unit 21 outputs the pixel data Q1 to Qk with a delay amount (OE+Ds) set on the basis of the output timing signal LOAD-Gr. As indicated in FIG. 9 as "Latch Output (IC1)," the data latch unit 21 of the source driver 14-1 outputs the pixel data Q1 to Qk corresponding to the gradation voltage signals to be supplied to the pixel units on the gate lines GL1, GL2, GL3, GL4 . . . GL4317, GL4318, GL4319, and GL4320 at the timing of V1, V2, V3, V4 . . . V4317, V4318, V4319, and V4320, for example. Similarly, the data latch unit 21 of the source driver 14-*y* outputs the pixel data Q1 to Qk corresponding to the gradation voltage signals to be supplied to the pixel units on each gate line at the timing indicated in FIG. 9 as "Latch Output (ICy)."

Figure 10:
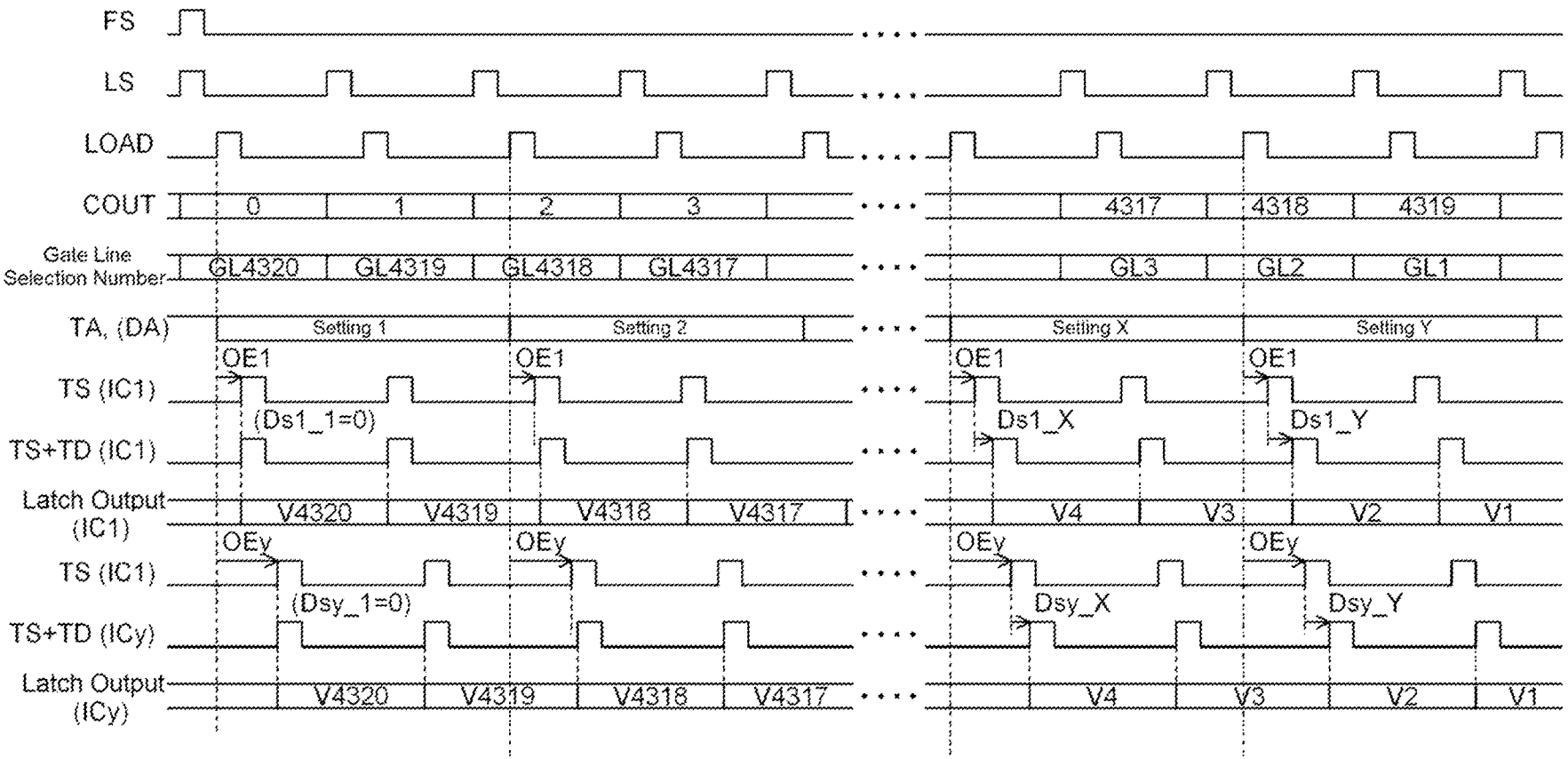
FIG. 10 is a timing chart showing the output timing for when source output is performed from the end farther from the source driver to the end closer to from the source driver of Embodiment 2.

FIG. 10, unlike FIG. 9, shows a case in which the gradation voltage signals (that is, the source output) are supplied in a direction from the pixel unit on the far end of the source line, which is farthest from the source driver, towards the pixel unit on the close end of the source line, which is closest to the source driver.

Similarly to the timing chart of FIG. 9, the gate line counter 31 performs counting on the basis of the line signal LS and outputs the counter output COUT indicating the count value. The gate line to which the source output is to be supplied is selected according to the counter output COUT of the gate line counter 31.

If the gradation voltage signals Vd1 to Vdk are being supplied in a direction from the position on the gate line farthest from the source driver (that is, the far end of the source line) to the position on the gate line closest to the source driver (that is, the close end of the source line), then the gate lines to be supplied the source output are selected in the order of the gate lines GL4320, GL4319, GL4318, GL4317, . . . GL3, GL2, and GL1.

The setting of the delay amounts OE1 to OEy by the gate line direction output delay timing generation unit 41, the setting of the delay amount Ds by the source line direction output delay timing generation unit 42, and the setting to the data latch unit 21 of the delay amount obtained by adding the aforementioned values together is similar to the timing chart of FIG. 9.

The data latch unit 21 outputs the pixel data Q1 to Qk with a delay amount (OE+Ds) set on the basis of the output timing signal LOAD-Gr. As indicated in FIG. 10 as "Latch Output (IC1)," the data latch unit 21 of the source driver 14-1 outputs the pixel data Q1 to Qk corresponding to the gradation voltage signals to be supplied to the pixel units on the gate lines GL4320, GL4319, GL4318, GL4317 . . . GL4, GL3, GL2, and GL1 at the timing of V4320, V4319, V4318, V4317 . . . V4, V3, V2, and V1, for example. Similarly, the data latch unit 21 of the source driver 14-*y* outputs the pixel data Q1 to Qk corresponding to the gradation voltage signals to be supplied to the pixel units on each gate line at the timing indicated in FIG. 10 as "Latch Output (ICy)."

In this manner, it is possible to control the output timing in a similar manner regardless of whether the source output is performed from the near end to the far end of the source lines (FIG. 9) or the source output is performed from the far end to the near end of the source lines (FIG. 10).

As described above, in the display device of the present embodiment, the gate line direction output delay timing generation unit 41 that is a first output delay setting unit sets a first delay time (delay amount OE) for the source output such that the delay amount increases as the distance in the gate line direction (that is, the distance from the gate driver) increases. Also, the source line direction output delay timing generation unit 42 that is a second output delay setting unit sets a second delay time (delay amount Ds) for the source output such that the delay amount decreases as the distance in the source line direction (that is, the distance from the source driver) increases. The timing control unit 24 sets the delay time calculated by adding the first delay time (OE) and the second delay time (Ds) as the delay time for outputting the pixel data Q1 to Qk from the data latch unit 21.

Thus, the timing of the output of the pixel data Q1 to Qk from the data latch unit 21 is adjusted, and as a result, the timing for supply of the gradation voltage signals from each source driver to the pixel unit is adjusted. As a result of this timing adjustment, it is possible to set the pixel charging rate of the pixel units P11 to Pnm to be uniform for the entire display panel.

Figure 11:
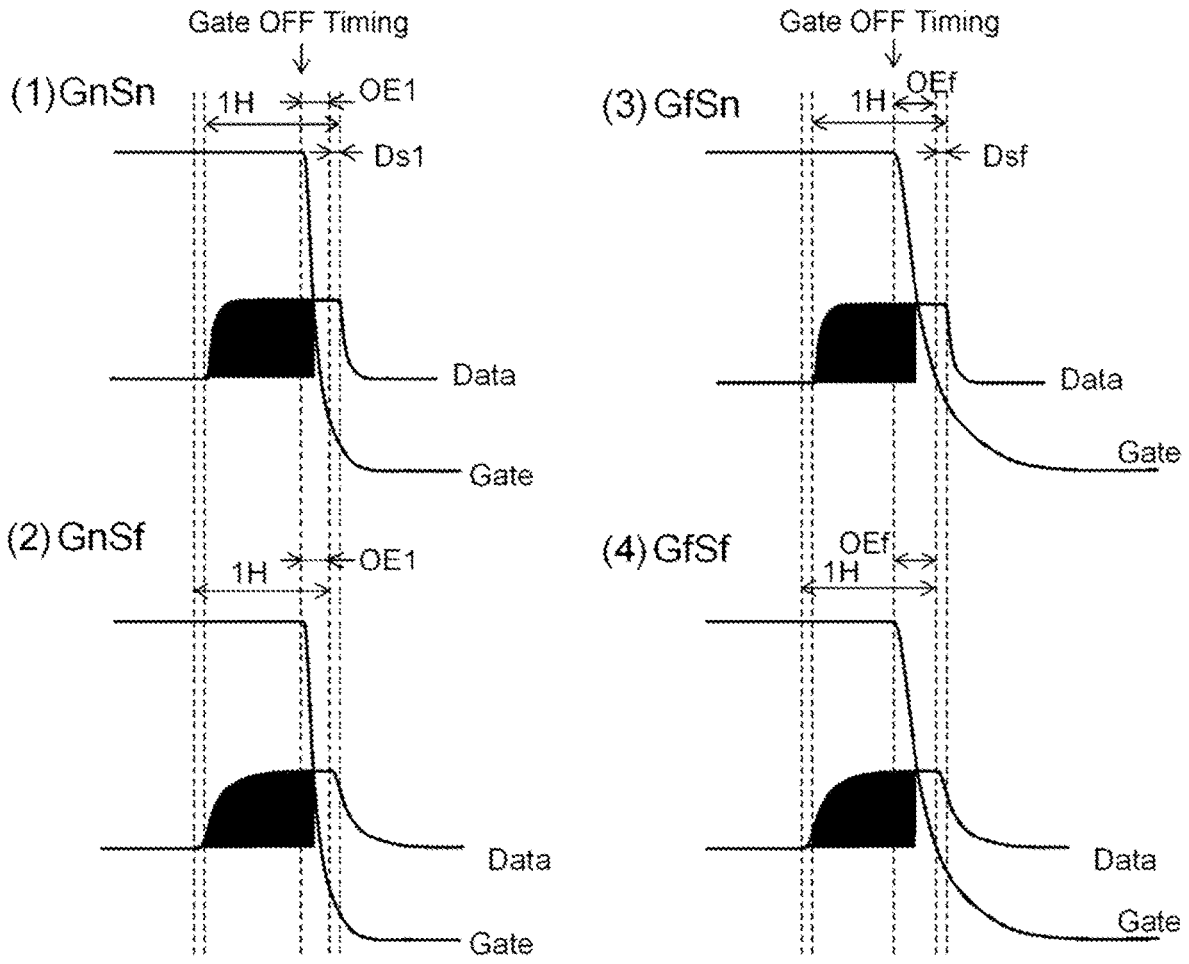
FIG. 11 shows signal waveforms of the gate signal and the gradation voltage signal in each of the pixel areas of Embodiment 2.

FIG. 11 shows signal waveforms and timings of the gate signal and the gradation voltage signal in each of the pixel areas on the display panel. Numbers (1) to (4) respectively correspond to the regions "GnSn," "GnSf," "GfSn," and "GfSf" of the pixel units shown in FIG. 5. Similarly to FIG. 6, the gate signals of FIG. 11 are also examples of signal waveforms in which a gate selection period (high level period) during which a selected pixel unit is pre-charged (so-called gate pre-charging) is long, and the rising portions of the gate signals are omitted.

In comparing GnSn (1) and GfSn (3), at GnSn, the distance from the gate driver 13A or 13B is close and the effect of impedance on the gate lines is small, and thus, there is little reduction in sharpness of the fall of the signal waveform of the gate signal (indicated as "Gate" in the drawing). By contrast, at GfSn, the distance from the gate driver 13A or 13B is far and the effect of impedance on the gate lines is great, and thus, there is a great reduction in sharpness of the fall of the signal waveform of the gate signal. Thus, to match the timing of the fall of the gate signal (that is, the gate OFF timing), the delay amount OE1 is set to be small in GnSn and the delay amount OEf is set to be large in GfSn. This similarly applies to the comparison of GnSf (2) and GfSf (4).

Next, in comparing GnSn (1) and GnSf (2), at GnSn, the distance from the source drivers is close and the effect of impedance on the source lines is small, and thus, there is little reduction in sharpness of the rise and fall of the signal waveform of the gradation voltage signals (indicated as "Data" in the drawing). By contrast, at GnSf, the distance from the source drivers is far and the effect of impedance on the source lines is great, and thus, there is a great reduction in sharpness of the rise and fall of the signal waveform of the gradation voltage signals. Thus, in GnSn, the delay amount Ds (=Ds1) is set to be large and in GnSf, the delay amount Ds is set to be small (Ds1=0 in FIG. 11), to match the timing of the rise of the source signal and the fall of the gate signal. This similarly applies to the comparison of GfSn (3) and GfSf (4).

In (1) to (4) of FIG. 11, the black portions schematically show the pixel area charging rate in the pixel units of each pixel area. That is, the area of the black portions corresponds to the result of taking the integral of the gradation voltage signal during the period from when the rise of the gradation voltage signal (Data) starts to when the gate signal decreases to less than or equal to the gradation voltage.

In the display device of the present embodiment, in the pixel areas (GfSn, GfSf) where the fall of the gate signal is slow (not sharp), the output of the gradation voltage signal is delayed compared to pixel areas where the fall of the gate signal is fast (sharp), and in pixel areas (GnSn, GfSn) where the rise of the gradation voltage signal is fast (sharp), the output of the gradation voltage signal is delayed compared to pixel areas (GnSf, GfSf) where the rise of the gradation voltage signal is slow (not sharp), thereby setting the timing of the source output such that the area of the black portions is substantially the same. As a result, the pixel charging rate is set to be uniform for the pixel units in the plane of the display panel.

Figure 12:
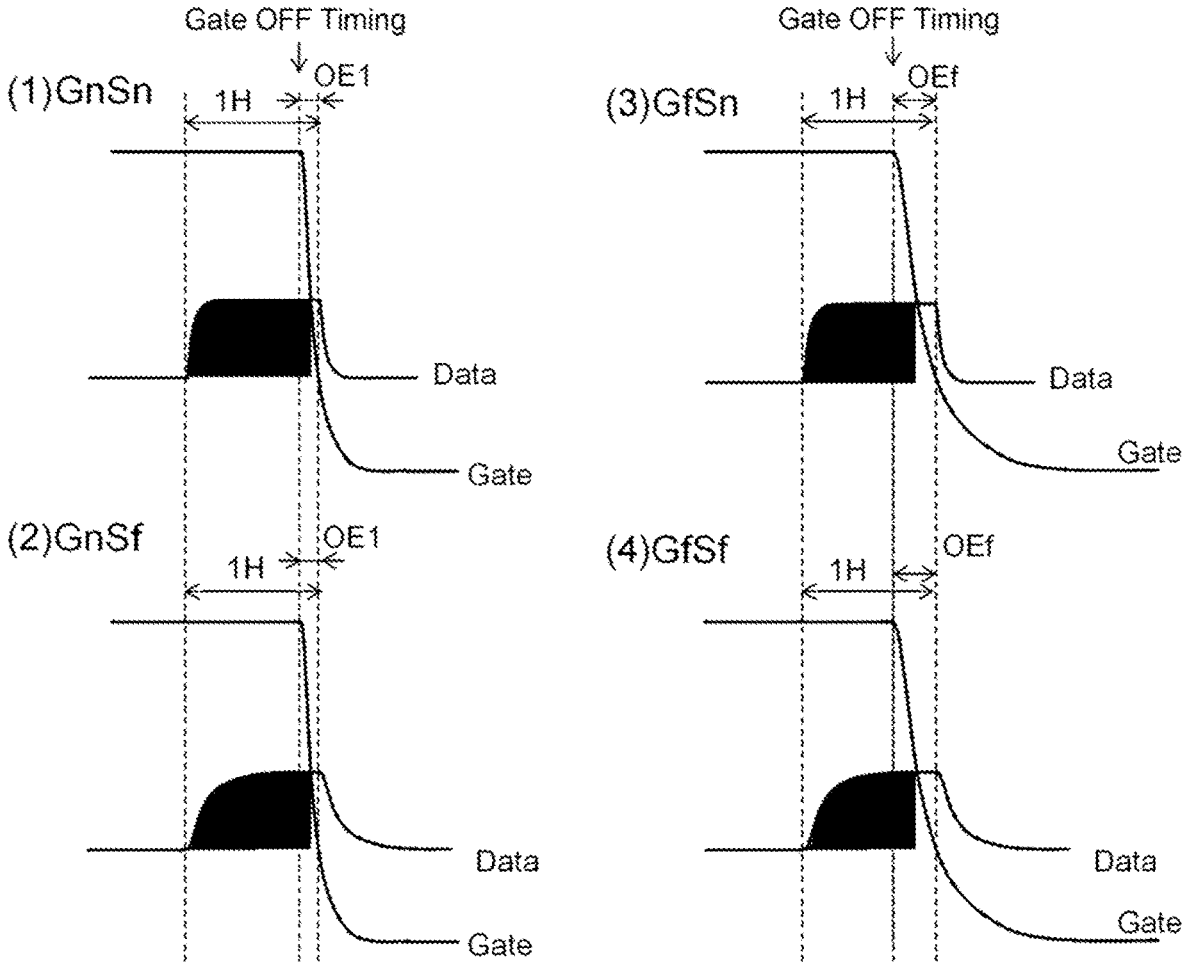
FIG. 12 shows signal waveforms of the gate signal and the gradation voltage signal in each pixel area according to a comparison example in which adjustment of the output delay was performed only in consideration of the gate line direction.

Unlike the display device of the present embodiment, FIG. 12 shows signal waveforms of the gate signal and the gradation voltage signal in each pixel area according to a comparison example in which adjustment of the output delay was performed only in consideration of the gate line impedance.

In comparing GnSn (1) and GfSn (3), in pixel areas where the distance from the gate driver 13A or 13B is far, the delay amount OE is set to be greater than in pixel areas close to the gate driver 13A or 13B (OEf>OE1), and thus, the pixel charging rate in GfSn is decreased and the difference from the pixel charging rate of GnSn is increased. This similarly applies to the comparison of GnSf (2) and GfSf (4).

In the comparison of GnSn (1) and GnSf (2), adjustment of the delay time according to the distance from the source driver is not performed, and thus, the pixel charging rate of pixel areas far from the source driver is lower than for the pixel areas close to the source driver.

Thus, the pixel charging rate of the pixel area of GnSn (1) is the highest, and the pixel charging rate of the pixel area of GfSf is the lowest, and therefore, the difference in pixel charging rate, that is, the difference in luminance in the plane of the display panel is large.

By contrast, in the display device of the present embodiment, as described above, the delay time for the source output is adjusted in consideration of both the effect of impedance on the gate lines and the effect of impedance on the source lines, and thus, the pixel charging rate, that is, the luminance in the plane of the display panel can be made uniform.

The present invention is not limited to the embodiments above. The embodiments above describe cases in which the display device 100 is a liquid crystal display device, but an organic EL (electroluminescence) display device may instead by used, for example. If the display device 100 is an organic EL display device, then the pixel units P11 to Pnm each include an organic EL element and a thin film transistor that controls the current flowing to the organic EL element. Display is performed by the thin film transistors controlling the current flowing to the organic EL elements according to the gradation voltage signals Vd1 to Vdm supplied to the pixel units P11 to Pnm, and changing the light emission luminance of the organic EL elements according to the current. It is possible to mitigate the occurrence of uneven luminance resulting from a decrease in writing voltage even when applying the present invention to an organic EL display device.

In the embodiments above, examples were described in which the gradation voltage signals are supplied in order from the pixel units on the gate line closest to the source driver to the pixel units on the gate line farthest from the source driver. However, the order may be reversed such that the supply of the gradation voltage signals is conducted in the order of pixel units on the gate line farthest from the source driver to the pixel units on the gate line closest to the source driver. Even in such a case, by setting the timing for supply of the gradation voltage signal to be faster for pixel units farther from the source driver, it is possible to charge the pixel electrodes when the signal waveform of the gradation voltage signal has risen sufficiently as described in the embodiments above.

In the embodiments above, the gate drivers 13A and 13B are provided on both ends of the display panel 11, and supply of the gate signals is performed from both ends. However, a configuration may instead be adopted in which a gate driver is provided on only one end of the display panel 11 and the supply of gate signals is performed in one direction.

In the embodiments above, examples were described in which the gradation voltage signals are supplied using the source drivers 14-1 to **14-*p*** that are the plurality of source driver ICs. However, a configuration may be adopted in which the supply of all gradation voltage signals is performed using a single source driver. Any configuration may be adopted as long as the source driver(s) constituting a single source driver IC or a plurality of source driver ICs has/have the following configuration.

That is, the source driver(s) is/are connected to the display panel (11) having m source lines (SL1 to SLm), n gate lines (GL1 to GLn) (m and n being integers of 2 or greater), and m×n pixel units (P11 to Pnm) provided in a matrix at the respective intersections between the m source lines and the n gate lines, and each source driver receives one frame of the image data signal (VDS) formed by a sequence of n pixel data piece groups that each include m pixel data pieces (PD) and generates the gradation voltage signals (Vd1 to Vdm) to be supplied to the m×n pixel units on the basis of the image data signal. The source driver(s) include(s): the data latch unit (21) that sequentially acquires the n pixel data piece groups from the image data signal at a prescribed period, and that sequentially outputs the m pixel data pieces included in the acquired pixel data piece groups from m output terminals corresponding to the m source lines; the gradation voltage conversion unit (22) that sequentially acquires the m pixel data pieces outputted from the data latch unit and converts the pixel data pieces to m gradation voltages; the output unit (23) that amplifies and outputs the m gradation voltages to the m source lines; and the timing control unit (24) that controls the timing of the output of the m pixel data pieces from the data latch unit. Each of the n pixel data piece groups corresponds to the gradation voltage signals supplied respectively to the n pixel columns constituted of the pixel units disposed along each of the n gate lines. The timing control unit controls the timing for the output from the data latch unit such that as the length of the source lines from the source driver to the pixel column increases, the difference is reduced between the timing for the data latch unit to acquire the pixel data piece group corresponding to the gradation voltage signals to be supplied to the pixel columns and the timing for the data latch unit to output the m pixel data pieces constituting the pixel data piece group.

Also, the timing control unit controls the timing for the output from the data latch unit such that as the length of the gate lines from the gate driver to each of the pixel units of the pixel column increases, the difference is increased between the timing for the output of one pixel data piece corresponding to the gradation voltage signal to be supplied to one pixel unit of the pixel column and the timing for the output of another pixel data piece corresponding to the gradation voltage signal to be supplied to another pixel unit adjacent to the one pixel unit.

According to this configuration of the source driver, it is possible to mitigate the occurrence of uneven luminance resulting from a decrease in writing voltage.

What is claimed is:

1. A source driver connected to a display panel having m source lines and n gate lines (m and n being integers of 2 or greater), and m×n pixel units provided in a matrix at respective intersections between the m source lines and the n gate lines, the source driver being configured to receive one frame of an image data signal formed by a sequence of n pixel data piece groups that each include m pixel data pieces and to generate gradation voltage signals to be supplied to the m×n pixel units on a basis of the image data signal, the source driver comprising:

a data latch unit configured to sequentially acquire the n pixel data piece groups from the image data signal at a prescribed period and sequentially output, from m output terminals corresponding to the m source lines, the m pixel data pieces included in an acquired pixel data piece group;

a gradation voltage conversion unit configured to sequentially acquire the m pixel data pieces outputted from the data latch unit and convert the pixel data pieces to m gradation voltages;

an output unit configured to amplify and output the m gradation voltages to the m source lines; and a timing control unit configured to control a timing for outputting the m pixel data pieces from the data latch unit, wherein each of the n pixel data piece groups corresponds to ones of the gradation voltage signals supplied respectively to n pixel columns constituted of pixel units disposed along each of the n gate lines, and wherein the timing control unit controls the timing for the outputting from the data latch unit such that as a length of the source lines from the source driver to the pixel columns increases, a timing difference decreases between a timing at which the pixel data piece groups corresponding to the ones of the gradation voltage signals supplied to the pixel columns are acquired by the data latch unit, and a timing at which the m pixel data pieces included in the pixel data piece groups are outputted by the data latch unit.

2. The source driver according to claim 1, wherein the timing control unit controls the timing for the outputting of the data latch unit such that as a length of the gate lines from a gate driver to each of pixel units of a pixel column increases, a timing difference increases between a timing at which one pixel data piece corresponding to a gradation voltage signal to be supplied to one pixel unit of the pixel column is outputted, and a timing at which another pixel data piece corresponding to a gradation voltage signal supplied to another pixel unit of the pixel column and adjacent to the one pixel unit is outputted.

3. The source driver according to claim 1, wherein the display panel is connected to a gate driver that supplies a gate signal to each of the m×n pixel units through the n gate lines, and wherein the timing control unit controls the timing for the outputting of the data latch unit such that as a length of the gate lines from the gate driver to each of m pixel units of the pixel columns increases, a timing difference increases between a timing at which the data latch unit acquires a pixel data piece corresponding to a gradation voltage signal to be supplied to the pixel unit, and a timing for output by the data latch unit of the m pixel data pieces of the pixel data piece group.

4. The source driver according to claim 1, wherein the timing control unit has a counter that is configured to count the n pixel data piece groups in association with each of the n gate lines for each of the pixel data piece groups, and controls the timing for the data latch unit to output the m pixel data pieces on a basis of a counter value of the counter.

5. A display device, comprising:

a display panel having m source lines and n gate lines (m and n being integers of 2 or greater), and m×n pixel units provided in a matrix at respective intersections between the m source lines and the n gate lines;

a display controller configured to output an image data signal formed by a sequence of a plurality of pixel data pieces;

a gate driver configured to supply a gate signal to the m×n pixel units through the n gate lines; and a plurality of source drivers that are provided for every prescribed number of source lines among the m source lines, the plurality of source drivers being configured to receive supply of the image data signal from the display controller, and being configured to each output, to the prescribed number of source lines, a gradation voltage signal based on the image data signal according to a timing at which the gate signal is supplied from the gate driver, wherein each of the plurality of source drivers includes:

a data latch unit configured to sequentially acquire the pixel data pieces forming the image data signal at a prescribed period for each of a prescribed number of pixel data pieces, and to output the prescribed number of pixel data pieces from output terminals corresponding to the prescribed number of source lines;

a gradation voltage conversion unit configured to sequentially acquire the prescribed number of pixel data pieces outputted from the data latch unit and to convert a pixel data pieces signal to a prescribed number of gradation voltage signals;

an output unit configured to amplify and output the prescribed number of gradation voltage signals to the prescribed number of source lines; and a timing control unit configured to control a timing for outputting the pixel data pieces from the data latch unit, wherein the timing control unit includes:

a first output delay setting unit configured to set a first delay time such that a time interval from acquisition to output by the data latch unit of pixel data pieces corresponding to gradation voltage signals to be supplied to a prescribed number of pixel units increases as a length of the gate lines from the gate driver to the prescribed number of pixel units increases; and a second output delay setting unit configured to set a second delay time such that a time interval from acquisition to output by the data latch unit of the pixel data pieces corresponding to the gradation voltage signals to be supplied to the prescribed number of pixel units decreases as a distance from the source driver to each of the gate lines, on which each of the prescribed number of pixel units is disposed, increases, and wherein the timing for outputting the pixel data pieces from the data latch unit is controlled on a basis of an output delay time determined according to the first delay time and the second delay time.

6. The display device according to claim 5, wherein the second output delay setting unit sets the second delay time such that the second delay time changes in stages for each of the gate lines in relation to gate signals of gate lines that are sequentially selected.

7. The display device according to claim 5, wherein the first output delay setting unit of each of the plurality of source drivers sets the first delay time so as to include at least a delay time of a first channel and a delay time that changes in stages among channels for each of the source drivers.

8. The display device according to claim 5, wherein the timing control unit further includes a setting storage unit that stores setting information supplied at a prescribed timing to each of the plurality of source drivers from the display controller, wherein the setting information includes setting information for a delay time for the prescribed timing corresponding to the supply of the gate signal, wherein the setting information for the delay time includes at least setting information for a delay time for a first channel of each source driver, setting information for a delay time between channels based on a gate signal delay, and setting information for a delay time for each of prescribed gate lines based on a source signal delay and a number of steps indicating a number of stages over which the delay time is changed, wherein the first delay time is set in the first output delay setting unit on a basis of the setting information for the delay time of the first channel and the delay time between the channels from the setting storage unit, and wherein the second delay time is set in the second output delay setting unit on the basis of the setting information for the delay time for the prescribed gate line and the number of steps from the setting storage unit.

9. The display device according to claim 8, wherein the setting information for the delay time additionally includes setting information for performing an adjustment such that an output timing for a last channel of a source driver adjacent to the source driver is smooth and continuous with an output timing for the first channel of the source driver.

10. A source driver that is connected to a display panel having m source lines and n gate lines (m and n being integers of 2 or greater), and m×n pixel units provided in a matrix at respective intersections between the m source lines and the n gate lines, the source driver being configured to receive an image data signal formed by a sequence of a plurality of pixel data pieces, to generate gradation voltage signals to be supplied to a plurality of pixel units on a prescribed number of source lines among the m source lines on a basis of the image data signal, and to output the gradation voltage signals to the prescribed number of source lines according to a timing to supply a gate signal from a gate driver connected to the n gate lines to the plurality of pixel units, the source driver comprising:

a data latch unit configured to sequentially acquire the pixel data pieces included in the image data signal at a prescribed period for each of a prescribed number of pixel data pieces, and to output the pixel data pieces from output terminals corresponding to the prescribed number of source lines;

a gradation voltage conversion unit configured to sequentially acquire the prescribed number of pixel data pieces outputted from the data latch unit and to convert a pixel data pieces signal to a prescribed number of gradation voltage signals;

an output unit configured to amplify and output the prescribed number of gradation voltage signals to the prescribed number of source lines; and a timing control unit configured to control a timing for outputting the pixel data pieces from the data latch unit, wherein the timing control unit includes:

a first output delay setting unit configured to set a first delay time such that a time interval from acquisition to output by the data latch unit of pixel data pieces corresponding to gradation voltage signals to be supplied to a prescribed number of pixel units increases as a length of the gate lines from the gate driver to the prescribed number of pixel units increases; and a second output delay setting unit configured to set a second delay time such that a time interval from acquisition to output by the data latch unit of the pixel data pieces corresponding to the gradation voltage signals to be supplied to the prescribed number of pixel units decreases as a distance from the source driver to each of the gate lines, on which each of the pixel units is disposed, increases, and wherein the timing for outputting the pixel data pieces from the data latch unit is controlled on a basis of an output delay time determined according to the first delay time and the second delay time.

11. The source driver according to claim 10, wherein the second output delay setting unit sets the second delay time such that the second delay time changes in stages for each of the gate lines in relation to gate signals of gate lines that are sequentially selected.

12. The source driver according to claim 10, wherein the timing control unit further includes a setting storage unit that stores setting information supplied from outside of the source driver, wherein the setting information includes setting information for a delay time for a prescribed timing corresponding to the supply of the gate signal, wherein the setting information for the delay time includes at least setting information for a delay time for a first channel of the source driver, setting information for a delay time between channels based on a gate signal delay, and setting information for a delay time for each of prescribed gate lines based on a source signal delay and a number of steps indicating a number of stages over which the delay time is changed, wherein the first delay time is set in the first output delay setting unit on a basis of the setting information for the delay time of the first channel and the delay time between the channels from the setting storage unit, and wherein the second delay time is set in the second output delay setting unit on the basis of the setting information for the delay time for the prescribed gate line and the number of steps from the setting storage unit.

13. The source driver according to claim 12, wherein the setting information for the delay time additionally includes setting information for performing an adjustment such that an output timing for a last channel of a source driver adjacent to the source driver is smooth and continuous with an output timing for the first channel of the source driver.

* * * * *